US010723607B2

(12) United States Patent
Wenjing et al.

(10) Patent No.: US 10,723,607 B2
(45) Date of Patent: Jul. 28, 2020

(54) ELECTRIC PERSONNEL LIFT DEVICE

(71) Applicant: Big Lift, LLC, Lombard, IL (US)

(72) Inventors: Wu Wenjing, Hangzhou (CN); Weng Lijian, Hangzhou (CN); Wang Zheng, Hangzhou (CN); William John Pedriana, Elm Grove, WI (US)

(73) Assignee: BIG LIFT, LLC, Lombard, IL (US)

( * ) Notice: Subject to any disclaimer, the term of this patent is extended or adjusted under 35 U.S.C. 154(b) by 0 days.

(21) Appl. No.: 15/933,664

(22) Filed: Mar. 23, 2018

(65) Prior Publication Data

US 2018/0273366 A1 Sep. 27, 2018

Related U.S. Application Data

(63) Continuation-in-part of application No. 15/468,401, filed on Mar. 24, 2017, now Pat. No. 10,160,629.

(51) Int. Cl.

| | |
|---|---|
| ***B66F 11/04*** | (2006.01) |
| ***B66F 13/00*** | (2006.01) |
| ***B66F 17/00*** | (2006.01) |

(52) U.S. Cl.

CPC ..... *B66F 11/04* (2013.01); *B66F 13/00* (2013.01); *B66F 17/006* (2013.01)

(58) Field of Classification Search

CPC ..... B66F 11/04; B66F 17/006

See application file for complete search history.

(56) References Cited

U.S. PATENT DOCUMENTS

| | | | | |
|---|---|---|---|---|
| 1,759,424 A | | 6/1928 | Strauss | |
| 2,753,224 A | * | 7/1956 | Troche | B66F 11/04 182/113 |
| 2,762,659 A | | 9/1956 | Harlan et al. | |
| 3,180,450 A | | 4/1965 | Crager et al. | |
| 3,344,885 A | | 10/1967 | Rasmussen | |
| 3,417,841 A | | 12/1968 | Lebre | |
| 3,536,162 A | * | 10/1970 | Clarke | B66F 7/16 187/220 |
| 3,666,046 A | * | 5/1972 | Meineck, Jr. | E04G 1/18 182/145 |
| 3,776,500 A | * | 12/1973 | Foderaro | A61B 6/4464 248/333 |

(Continued)

FOREIGN PATENT DOCUMENTS

| | | | | |
|---|---|---|---|---|
| DE | 1171583 B | * | 6/1964 | B66B 5/22 |
| DE | 3112509 A1 | * | 12/1982 | B66F 11/04 |

(Continued)

*Primary Examiner* — Alvin C Chin-Shue

(74) *Attorney, Agent, or Firm* — Cook Alex Ltd.

(57) ABSTRACT

An electric personnel lift device that includes a base assembly having two columns that are laterally spaced apart. Each of the two columns has a lift cylinder device mounted in the respective column and extending upward. The electric personnel lift device further includes a height adjustable platform assembly having an operator platform and two laterally spaced apart handrail assemblies connected to the operator platform. The height adjustable platform assembly is connected to an upper end of a movable portion of each lift cylinder device and is slidably coupled to the columns, wherein the height adjustable platform assembly is movable between at least a lowered position and a raised position.

17 Claims, 30 Drawing Sheets

(56) References Cited

U.S. PATENT DOCUMENTS 3,887,155 A * 6/1975 Bertalot ..... F16B 7/10 248/333
3,958,376 A * 5/1976 Campbell ..... E04H 12/182 52/115
4,077,616 A * 3/1978 Smejkal ..... B66F 11/04 266/281
4,099,469 A * 7/1978 Sahli ..... A47B 3/00 108/1
4,101,005 A * 7/1978 Fewkes ..... A47B 9/10 182/148
4,589,520 A * 5/1986 Tapfer ..... B66F 11/04 182/46
4,657,112 A * 4/1987 Ream ..... B66F 11/04 182/127
5,119,907 A * 6/1992 Billington, III ..... B66F 11/04 182/113
5,121,816 A 6/1992 Curtin
5,203,425 A 4/1993 Wehmeyer
5,273,132 A 12/1993 Sasaki et al.
5,322,408 A 6/1994 Wooden
5,425,433 A * 6/1995 Huber ..... B66F 11/04 182/145
5,461,736 A 10/1995 Carpenter et al.
5,755,306 A 5/1998 Kraemer et al.
5,803,204 A 9/1998 White et al.
5,890,563 A * 4/1999 Avitan ..... B66F 9/205 187/228
5,941,341 A 8/1999 Gillis et al.
6,174,124 B1 1/2001 Haverfield et al.
6,241,047 B1 * 6/2001 Gilliland ..... B66F 9/06 180/19.3
7,140,467 B2 11/2006 Cook
7,438,180 B1 * 10/2008 Taylor ..... B65G 21/10 198/812
7,753,169 B1 * 7/2010 Kurtz ..... E06C 1/39 182/129
7,828,115 B2 11/2010 Sayles
8,231,096 B2 * 7/2012 Lee ..... B25J 5/04 248/326
8,863,899 B2 10/2014 Solhjem et al.
8,985,275 B2 3/2015 Solhjem et al.
9,108,831 B2 8/2015 Beji
9,212,038 B1 12/2015 Presti
2003/0209385 A1 * 11/2003 Kuehl ..... E06C 1/39 182/17
2007/0086880 A1 * 4/2007 Jordan ..... A61G 7/1011 414/630
2010/0050557 A1 * 3/2010 Falck-Schmidt ..... F16B 7/14 52/632
2013/0168185 A1 7/2013 Huang et al.

FOREIGN PATENT DOCUMENTS

DE 102010036409 A1 1/2012
FR 2717456 A1 9/1995
FR 2984292 A1 6/2013
GB 135834 A 7/1920
GB 885824 A 12/1961
GB 2493487 A 2/2013
WO WO 99/41186 8/1999

* cited by examiner

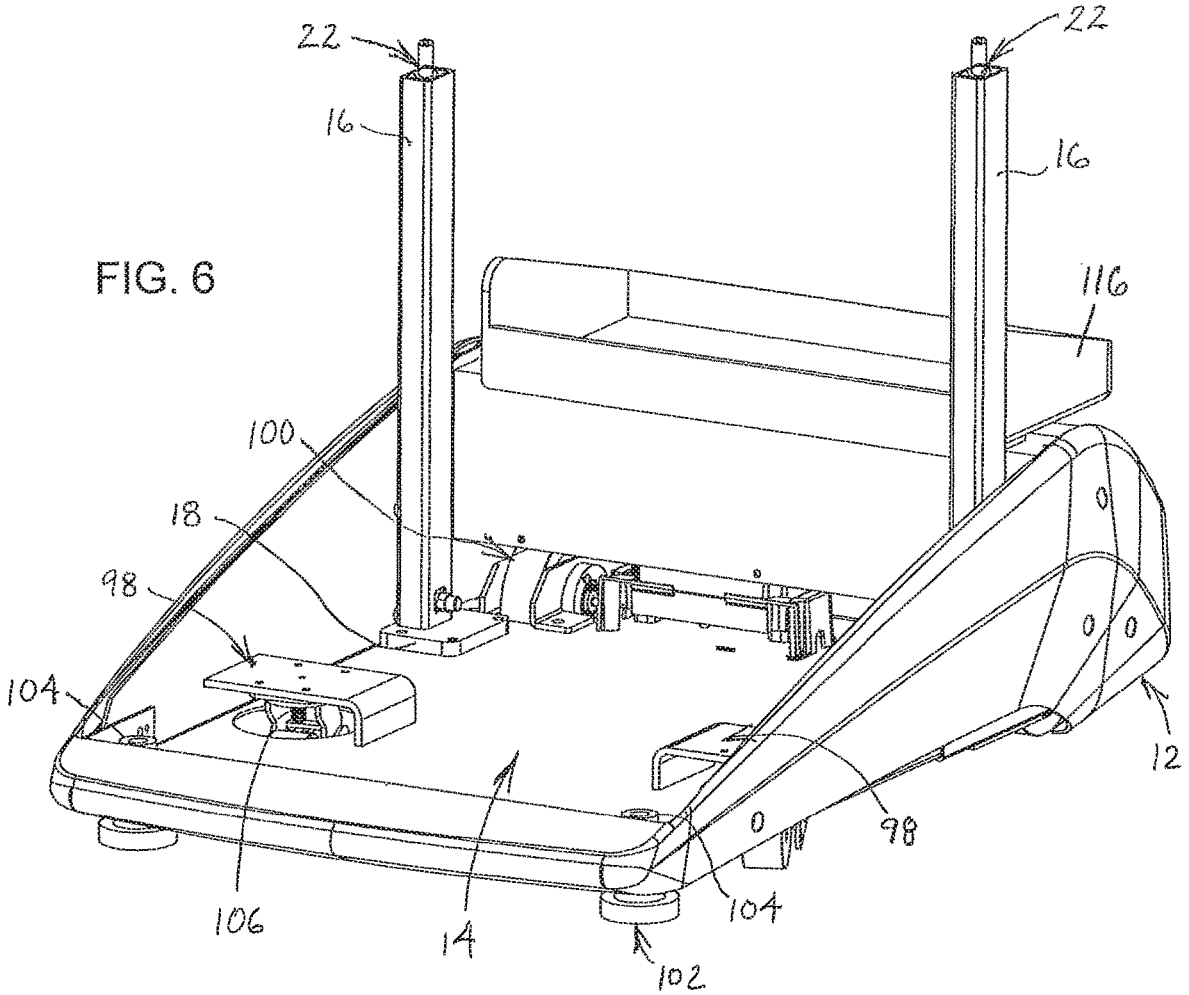
FIG. 6
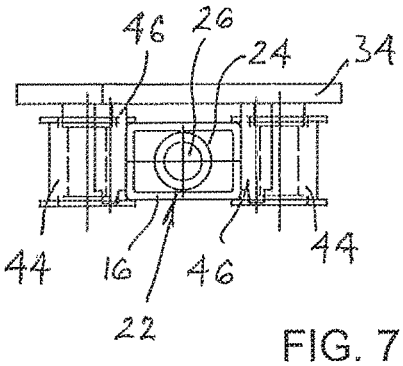
FIG. 7
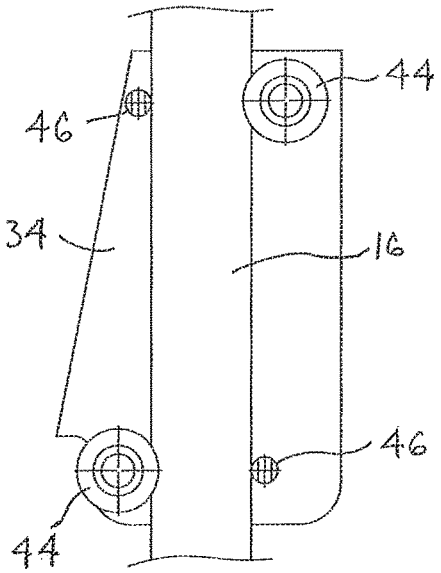

ELECTRIC PERSONNEL LIFT DEVICE

CROSS-REFERENCE TO RELATED APPLICATION

This application is a continuation-in-part of and claims the benefit of U.S. application Ser. No. 15/468,401, filed Mar. 24, 2017, the disclosure of which is hereby incorporated by reference in its entirety.

FIELD OF THE DISCLOSURE

The present disclosure relates generally to personnel lifts or order pickers, and more particularly, to compact electric low level personnel lift devices having a height adjustable platform that is operable to lift and lower an operator.

BACKGROUND

There are many instances in commercial settings, such as retail stores, warehousing or industrial environments, where objects are placed above the normal reach of an individual standing on a floor surface. Efficient storage tends to utilize shelving or cabinetry that essentially stacks objects vertically. As a result, an individual may need an increase in reach to grasp an elevated object.

There are numerous manual devices that may be used to climb to a higher position for grasping elevated objects, such as a ladder or step stool. Such devices typically are somewhat cumbersome to use because they must be lifted and carried to a location for use, or they may be in the form of a rolling staircase, which consumes a very large amount of floor space during use and when stowed. Devices that require climbing also can present safety concerns. Climbing requires increased physical effort, presents a potential tripping hazard while ascending and descending stairs, and requires the use of at least one hand to steady oneself, reducing the ability to use both hands to grasp and hold an object being retrieved.

Fully powered lift devices have been developed that permit a user to operate a lift platform to be moved to a higher position. Such devices often are referred to as stock pickers, because a user is able to ascend to a level where the user can reach a stocked item, and then descend to exit the lift and carry away the item. However, present order picker devices tend to have lift mechanisms that may include lift cylinders and/or chains, with both being located such that they are exposed. Lift cylinders and/or chains located on outside areas present a potential risk of injury for operators that may come into contact with such components during operation of the lift. Also, the lift cylinders and/or chains would be subject to damage by contact with other objects. Alternative designs tend to place a lift cylinder in the center of the device, to avoid such risks of injury and damage. This too has drawbacks, as the operator platform space may be compromised and/or the height of the operator platform in its lowered position may be higher than would be desirable for simply stepping onto a platform.

This disclosure sets forth example electric personnel lift devices and methods of using the same that overcome shortcomings in the prior art.

SUMMARY

Disclosed herein are advantageous example electric personnel lift devices that conceal the operative lift components to shield the components from damage and to prevent injury to the operator. The example devices provide larger holding or storage spaces, a low initial operator platform height, and avoid encroaching on the operator's space.

The example electric personnel lift devices may be used in various environments when a user is unable to grasp something that is placed above the user's reach. As noted, the devices may be particularly well suited for use as a stock picker for use in retail, warehousing or industrial settings where objects must be removed from vertically spaced shelving.

In a first aspect, the disclosure provides an advantageous device including an example electric personnel lift device. The electric personnel lift device includes a base assembly having a frame and two columns that are laterally spaced apart and connected to the frame. Each of the two columns has a lift cylinder device located in the respective column and extending upward. The electric personnel lift device further includes a height adjustable platform assembly having an operator platform and two laterally spaced apart handrail assemblies connected to the operator platform. The height adjustable platform assembly is connected to an upper end of a movable portion of each lift cylinder device and is slidably coupled to the columns, wherein the height adjustable platform assembly is movable between at least a lowered position and a raised position.

In a second aspect, the disclosure provides an electric personnel lift device including a base assembly having two columns that are laterally spaced apart, with each of the two columns having a lift cylinder device located in the respective column and extending upward. The electric personnel lift device also includes a height adjustable platform assembly having an operator platform and two laterally spaced apart handrail assemblies connected to the operator platform, with the height adjustable platform assembly being connected to an upper end of a movable portion of each lift cylinder device and being slidably coupled to the columns, wherein the height adjustable platform assembly is movable between at least a lowered position and a raised position.

The example electric personnel lift devices utilize an electric motor that drives a hydraulic system for smooth and powerful lifting. The electric motor is powered by a battery, which may be rechargeable. The example shown also conveniently includes a battery charger, with a retractable cord assembly to permit on-board battery charging.

The example electric personnel lift devices include wheel assemblies that make them portable and easy to manually roll from one location to another. The devices may include a parking or braking feature that causes the base assembly to retain its position or to rest on at least one foot when an operator steps onto the operator platform, so as to stop the device from rolling and to remain in place while the lift is being operated. Thus, the base assembly essentially may provide a self-parking configuration by which at least one foot of the base assembly moves from a raised position to a grounded position upon engaging an input device or when the operator platform is forced downward by an operator stepping onto the operator platform. The former may include a hydraulically or electrically actuated brake assembly to hold the vehicle in a particular position for use, while the latter provides an intuitive and easy to use feature that enhances the safety of the operator.

Thus, the present disclosure presents alternatives to prior art devices that extend the reach of an individual, and the examples disclosed provide advantageous features in more conveniently and efficiently utilized electric personnel lift devices. It is to be understood that both the foregoing general description and the following detailed description are exemplary and provided for purposes of explanation only, and are not restrictive with respect to the claimed subject matter. Further features and advantages will become more fully apparent in the following description of the example preferred embodiments and from the appended claims.

BRIEF DESCRIPTION OF THE DRAWINGS

In describing the preferred examples, references are made to the accompanying drawing figures wherein like parts have like reference numerals, and wherein:

FIG. 6 is a right rear perspective view of the base assembly but with a panel removed to expose the frame, the mounting of the columns and of the wheel assemblies.

FIG. 7 includes a side plan view and a top view of the slidable coupling of the height adjustable platform assembly to the columns;

Figure 1:
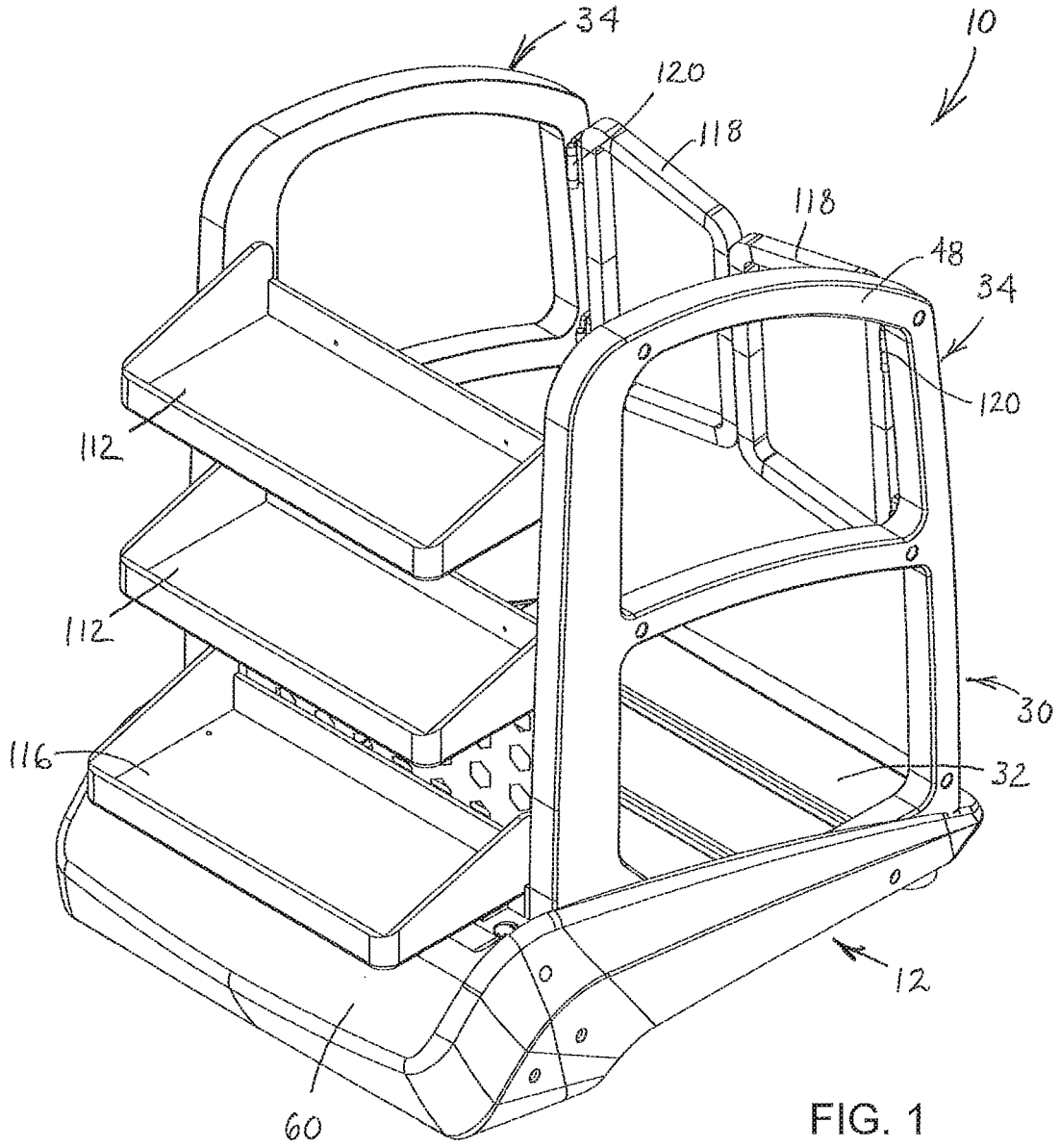
FIG. 1 is a left front perspective view of a first example electric personnel lift device having a height adjustable platform in a lowered position.

It should be understood that the drawings are not necessarily to scale. While some mechanical details of personnel lift devices, including some details of fastening or connecting means and other plan and section views of the particular components, have been omitted, such details are considered within the comprehension of those skilled in the art in light of the present disclosure. It also should be understood that the present disclosure is not limited to the examples illustrated.

DETAILED DESCRIPTION OF THE PREFERRED EMBODIMENT

This disclosure presents example electric personnel lift devices and methods of using the same, which may be embodied in several forms, two examples of which are shown in FIGS. 1-12 and FIGS. 13-33, respectively. FIGS. 1-12 illustrate a first example electric personnel lift device 10, as will be described further herein with reference to the accompanying drawings of the preferred embodiments. It will be appreciated, however, that the invention may be constructed and configured in various ways and is not limited to the example preferred embodiments shown and described herein.

The first example electric personnel lift device 10 includes a base assembly 12 having a frame 14 and two columns 16 that are laterally spaced apart and connected to the frame 14. Each column 16 is hollow and may be connected to the frame 14, for example, by being fixedly connected to a bracket 18, such as by welding, as may be seen in FIGS. 5, 6 and 8. The bracket 18 may, in turn, be connected to the frame 14, such as by being removably connected to the frame 14 by fasteners 20, which may include bolts or other suitable means of fastening, as may be seen in FIG. 8. It will be appreciated that there may be other suitable ways of connecting the columns to the frame.

Figure 5:
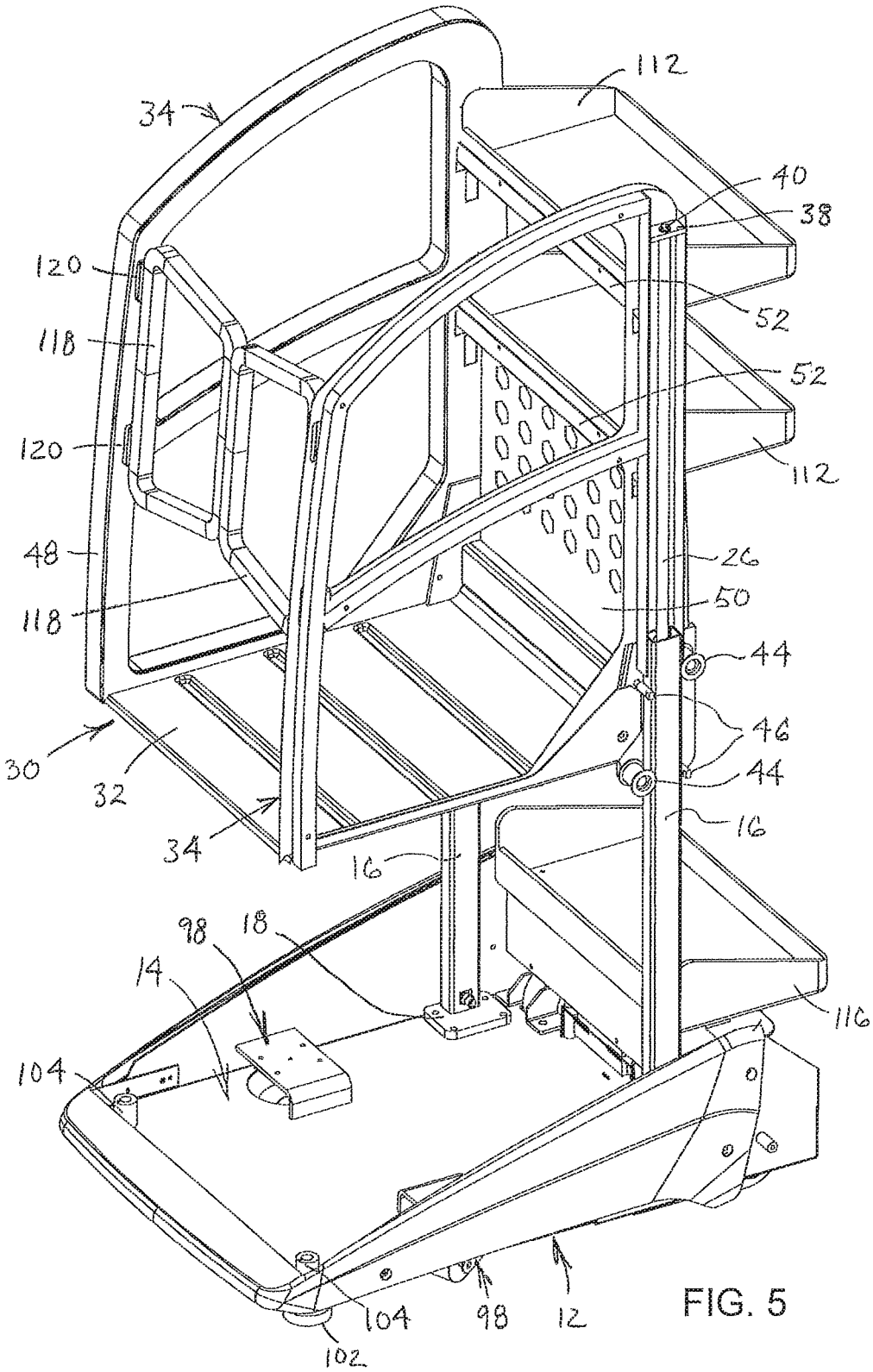
FIG. 5 is a right rear perspective view of the device of FIG. 1, in the raised position shown in FIG. 4, but with the right handrail assembly cover removed.
Figure 8:
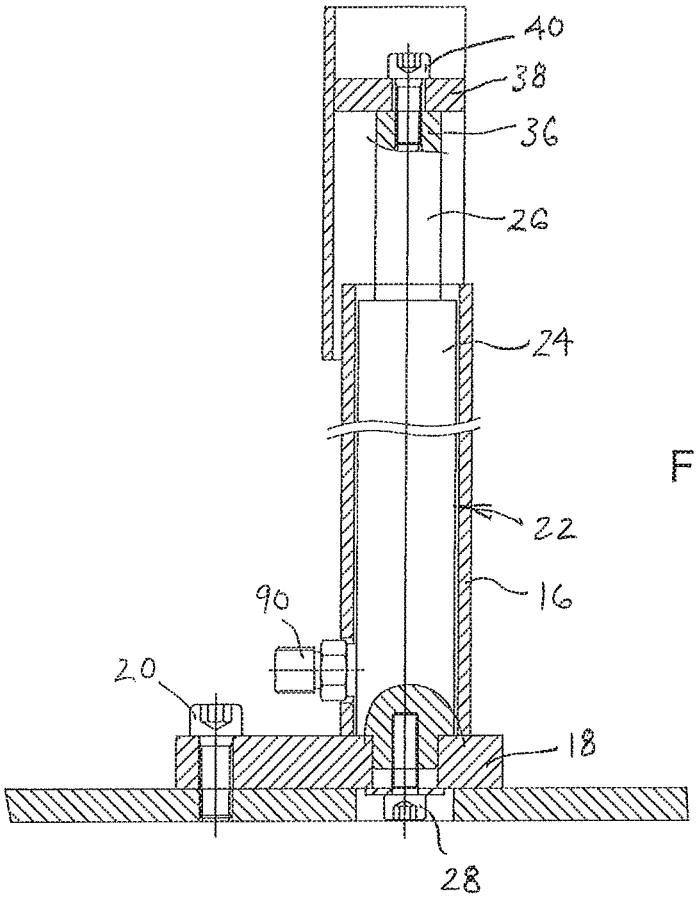
FIG. 8 is a front cross section view of the connection of the lift cylinder device and column to the base assembly of the device of FIG. 1.

Each of the two columns 16 has a lift cylinder device 22 located in the respective column 16 and extending upward, as may be appreciated in FIGS. 5 and 8. Each lift cylinder device 22 includes a lower cylinder 24 and a movable piston rod 26 that is further extendible upward. In this first example, each lift cylinder is removably connected to the bracket 18 by a fastener 28, although it will be appreciated that other suitable means of connection to the bracket 18, column 16 and ultimately the frame 14 of the base assembly 12 may be utilized.

A height adjustable platform assembly 30 has an operator platform 32 and two laterally spaced apart handrail assemblies 34 connected to the operator platform 32. As may be seen in FIGS. 5 and 8, the height adjustable platform assembly 30 of the first example is connected to an upper end 36 of a movable portion of each lift cylinder device 22 and is slidably coupled to the columns 16. For example, the upper end 36 of the piston rod 26 of the lift cylinder device 22 may be connected to a flange 38 in an upper portion of a handrail assembly 34, such as by a fastener 40, which may include a bolt or other suitable means of fastening.

Figure 2:
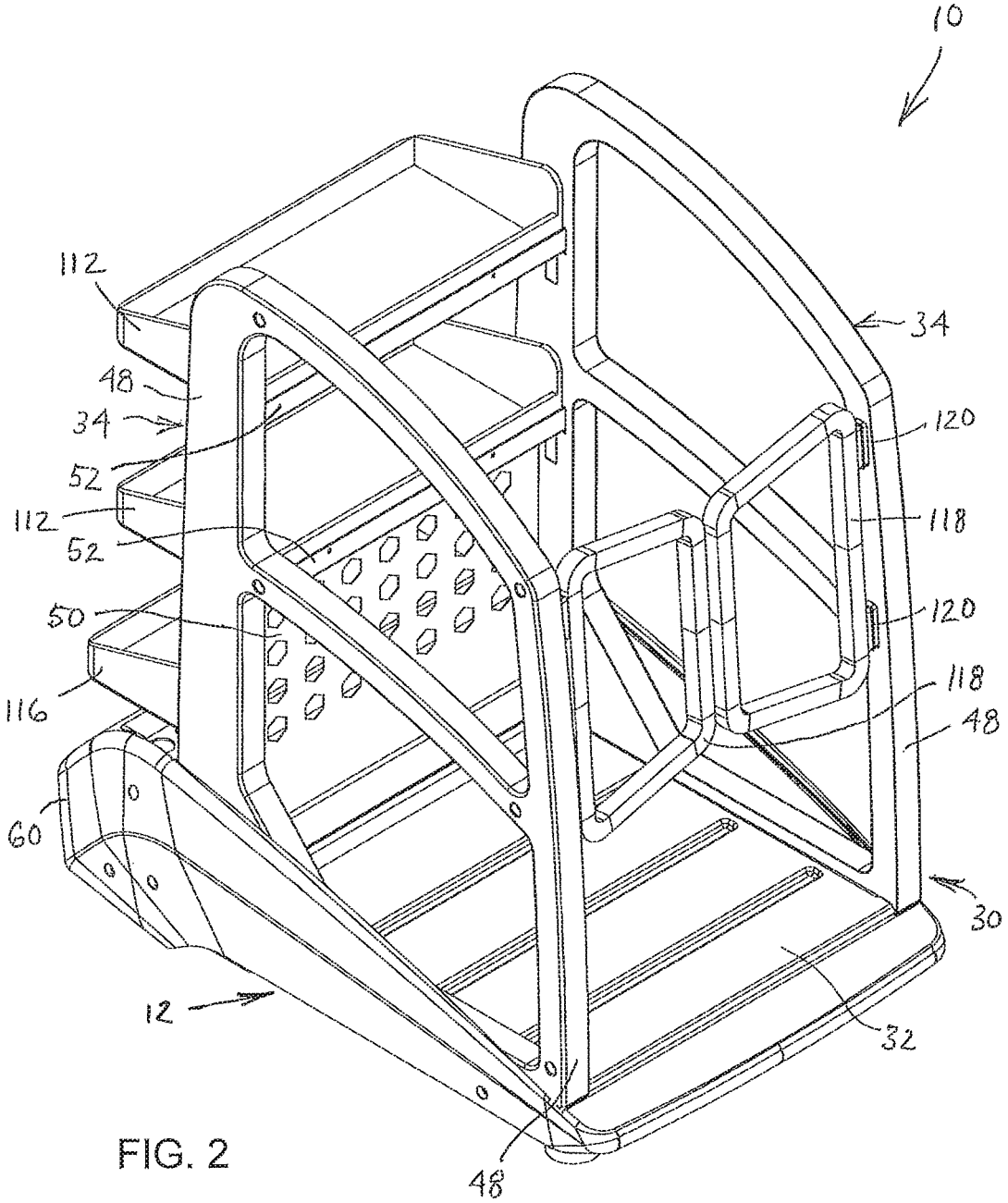
FIG. 2 is a left rear perspective view of the device of FIG. 1.
Figure 3:
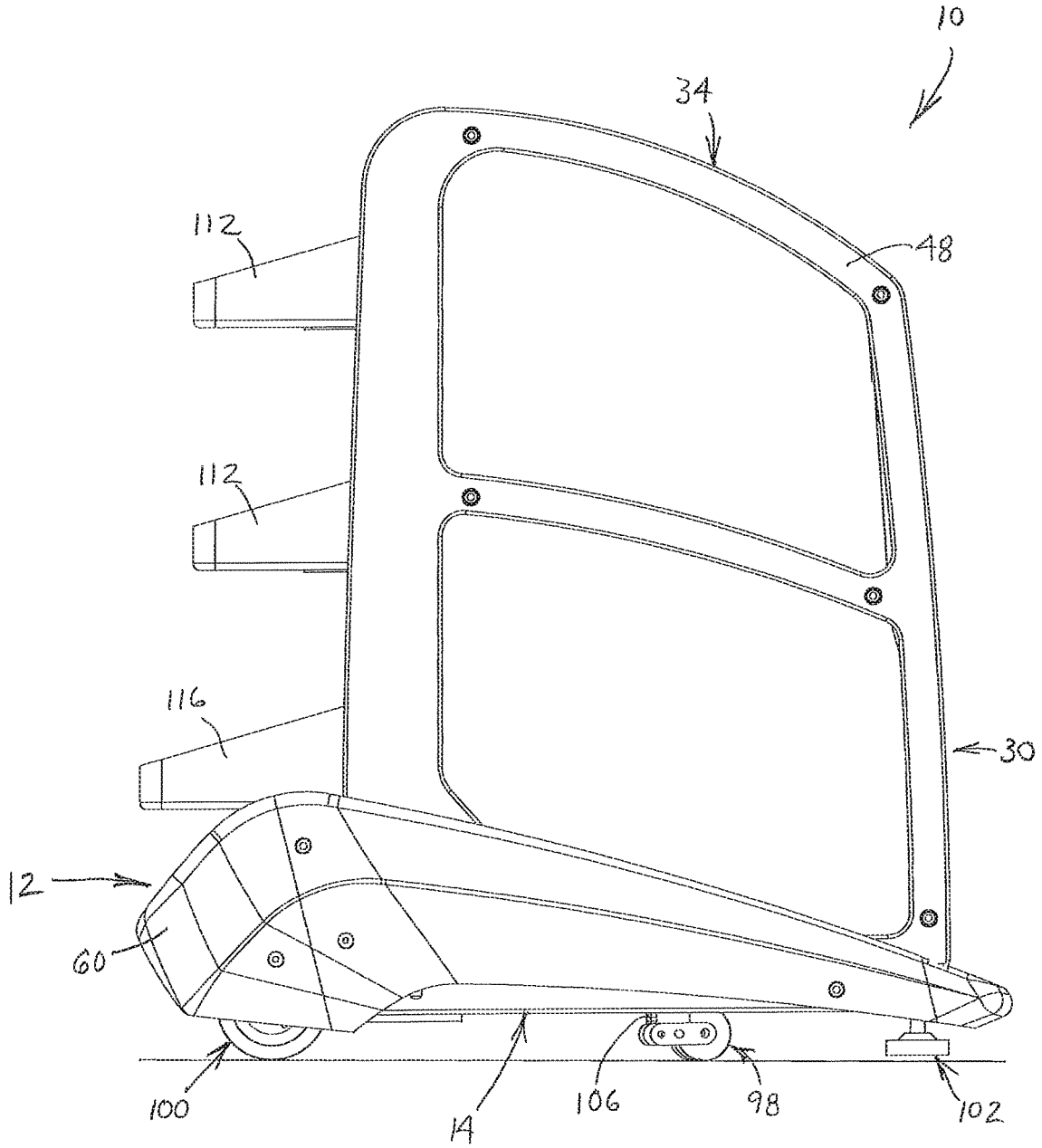
FIG. 3 is a left side plan view of the device of FIG. 1, shown on a floor surface.
Figure 4:
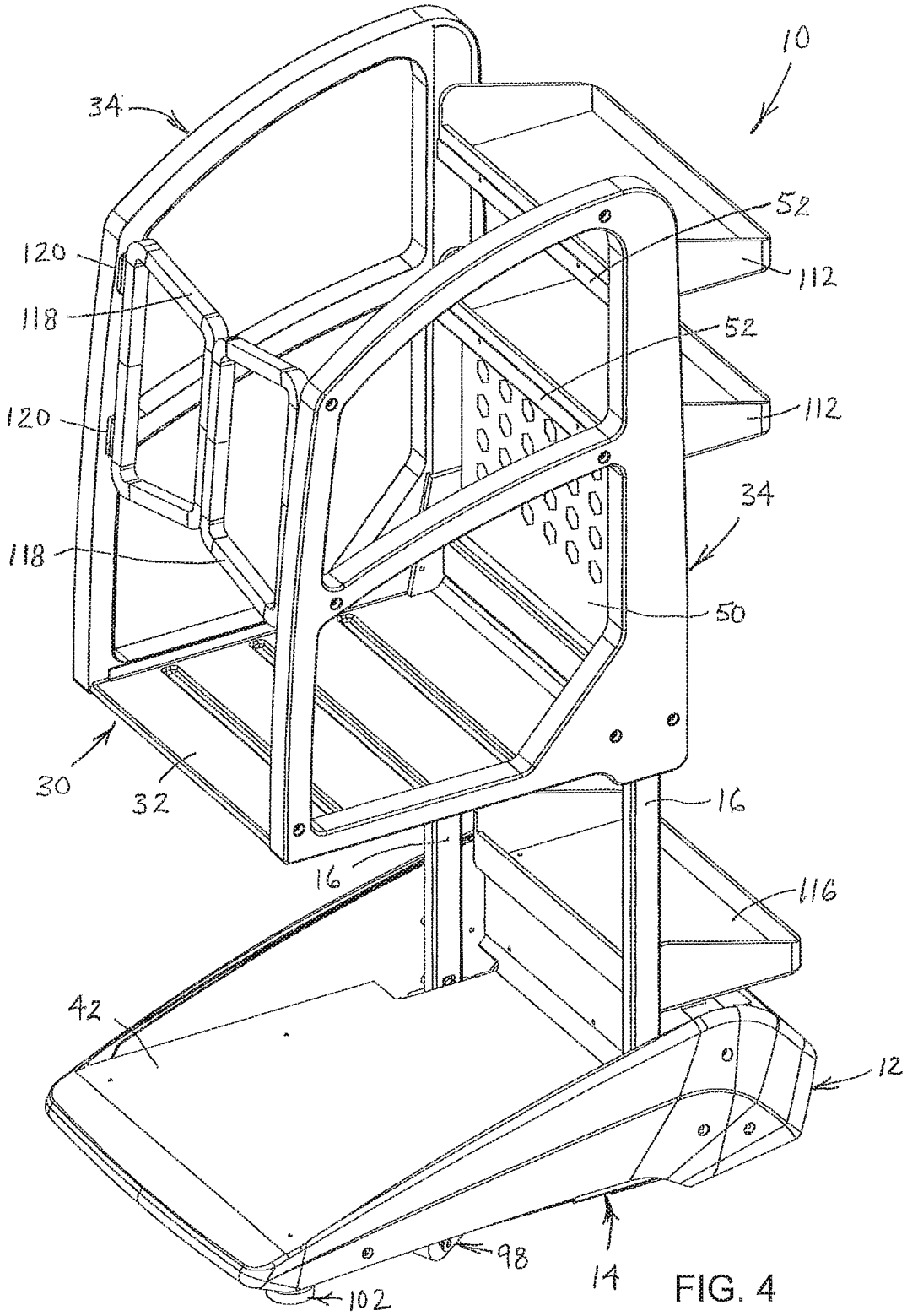
FIG. 4 is a right rear perspective view of the example electric personnel lift device of FIG. 1 having the height adjustable platform in a raised position above the base assembly.

The height adjustable platform assembly 30 is movable between at least a lowered position, seen in FIGS. 1-3, and a raised position, seen in FIG. 4. Moreover, when the height adjustable platform assembly 30 is in the lowered position, the operator platform 32 is adjacent the frame 14, which is concealed and protected by a panel 42 of the base assembly 12.

The height adjustable platform assembly 30 that is slidably coupled to the columns 16 further includes a set of at least two rollers 44 for each respective column 16 and the two rollers 44 engage opposite sides of the respective column 16. Each roller 44 has a curved surface that tends to keep it centered on the respective column 16. In addition, the rollers 44 that engage the columns 16 are located opposite posts 46 that are connected to the height adjustable platform assembly 30, with the columns 16 located between the rollers 44 and the posts 46. The handrail assemblies 34 conceal moving parts of the two lift cylinder devices 22, by use of an outer cover 48, as may be seen when comparing FIG. 4 to FIG. 5.

The height adjustable platform assembly 30 includes a front cross member 50 that is fixedly connected to the two laterally spaced apart handrail assemblies 34. In this first example, the front cross member 50 is in the form of a plate, which may be welded to the handrail assemblies 34. In addition, this example includes further cross members 52 that are located at higher positions along the handrail assemblies 34 and which provide increased stiffness to the height adjustable platform assembly 30.

Figure 9:
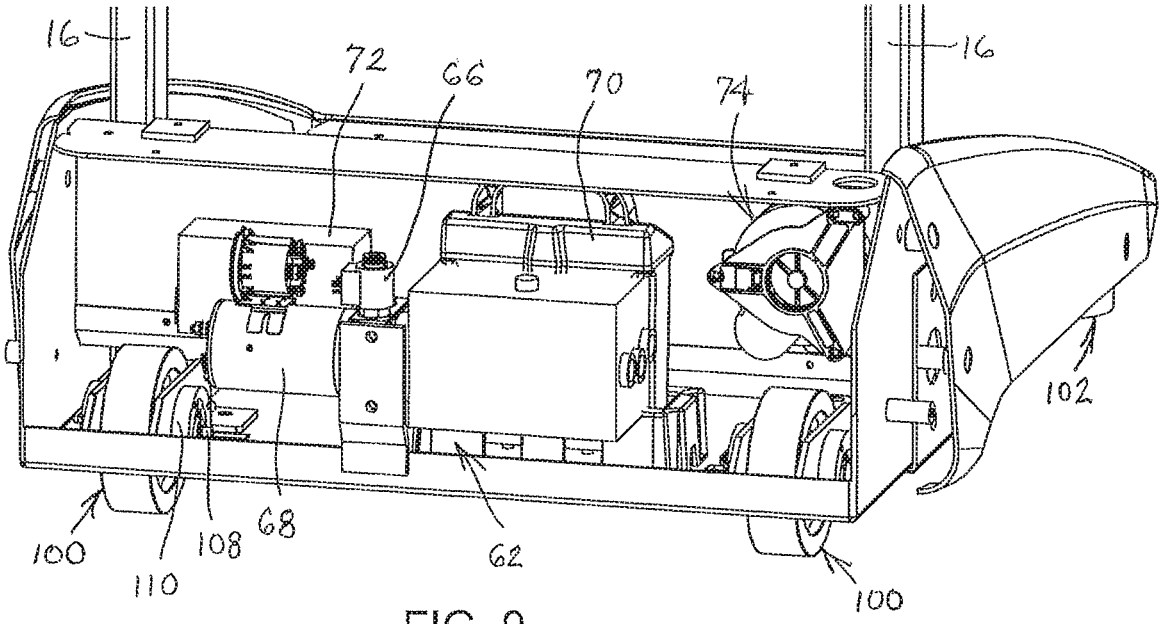
FIG. 9 is a front perspective view of a portion of the base assembly of the device of FIG. 4, but with a front cover removed.

The base assembly 12 of the electric personnel lift device 10 is shown in FIG. 9 with a front cover 60 removed to expose internal components that are otherwise protected, and with the wiring and fluid conduits removed for ease of viewing. For instance, in FIG. 9 one may see a hydraulic system 62 is mounted within the base assembly 12. The hydraulic system includes a fluid reservoir 64, a hydraulic pump, which is concealed within the reservoir 64, an electric hydraulic valve 66. The hydraulic system 62 further includes an electric motor 68 to drive the hydraulic pump. A power source 70 is provided for the electric motor 68. In this first example electric personnel lift device 10, the power source 70 includes a rechargeable battery. The base assembly 12 also houses a battery charger 72, with a reel device 74, which provides a retractable cord (not shown) for convenient on-board charging of the rechargeable battery 70. These features provide further convenience to the user and avoid having to remove a battery for charging.

Figure 10:
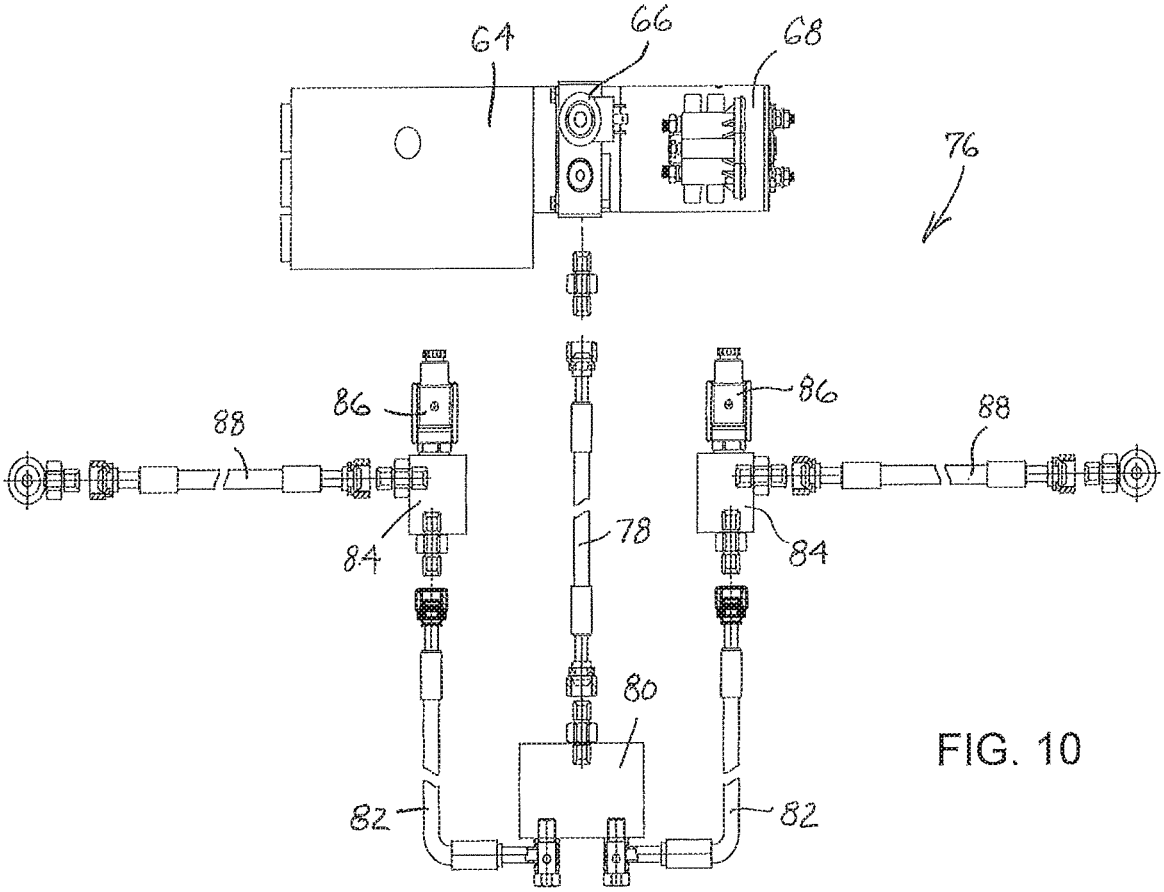
FIG. 10 is a schematic view of the fluid circuit for the hydraulic system of the device of FIG. 1.
Figure 11:
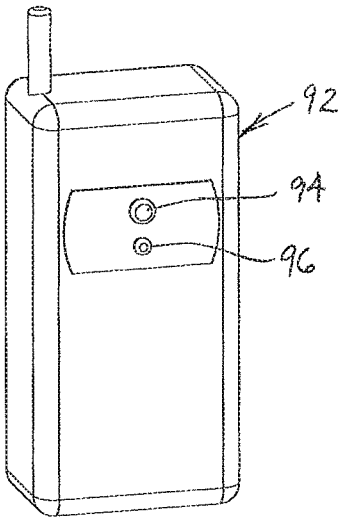
FIG. 11 is a perspective view of a remote control for use with the device of FIG. 1.

The hydraulic system 62 further includes a fluid circuit 76, a schematic view of which is shown in FIG. 10, for fluid connection of the pump and reservoir 64 to the lift cylinder devices 22. The fluid circuit 76 includes a main conduit 78 that extends from the reservoir 64 and valve 66 to a splitter body 80. The splitter body 80 divides the fluid flow into two branch conduits 82, which lead to control blocks 84 having further electric hydraulic valves 86. Connecting conduits 88 extend from the control blocks 84 to ports 90 at the bottom of the columns 16 for connection to the lower cylinders 24 of the lift cylinder devices 22, as may be appreciated when viewing FIGS. 8 and 10. It will be appreciated that the connections within the fluid circuit 76 and hydraulic system 62 may be by conventional means for simple upward and downward movement of the lift cylinder devices 22. Furthermore, an operator may operate the electric personnel lift device 10 by use of a handheld control device 92, in the form of a transmitter having simple buttons 94, 96 to send a signal to provide upward and downward movement of the height adjustable platform assembly 30. It will further be appreciated that a control device may be mounted on the electric personnel lift device 10, such as on an upper portion of one of the handrail assemblies 34, if desired.

The base assembly 12 of the electric personnel lift device 10 includes a plurality of wheel assemblies 98, 100, which extend downward to contact a ground surface. In addition, the base assembly includes at least one foot 102, which is capable of providing static support. In the example shown, the at least one foot 102 includes two feet 102 located along a lower surface 104 of the base assembly 12 proximate a rear portion of the base assembly 12. As may be appreciated by viewing FIGS. 5 and 12, while the feet 102 could be in the form of a fixed post, bar or other structure, the feet 102 of the present example are adjustable, such as by being threadably engaged with threaded receivers 104 that are fixedly connected to the frame 14, such as by welding.

Figure 12:
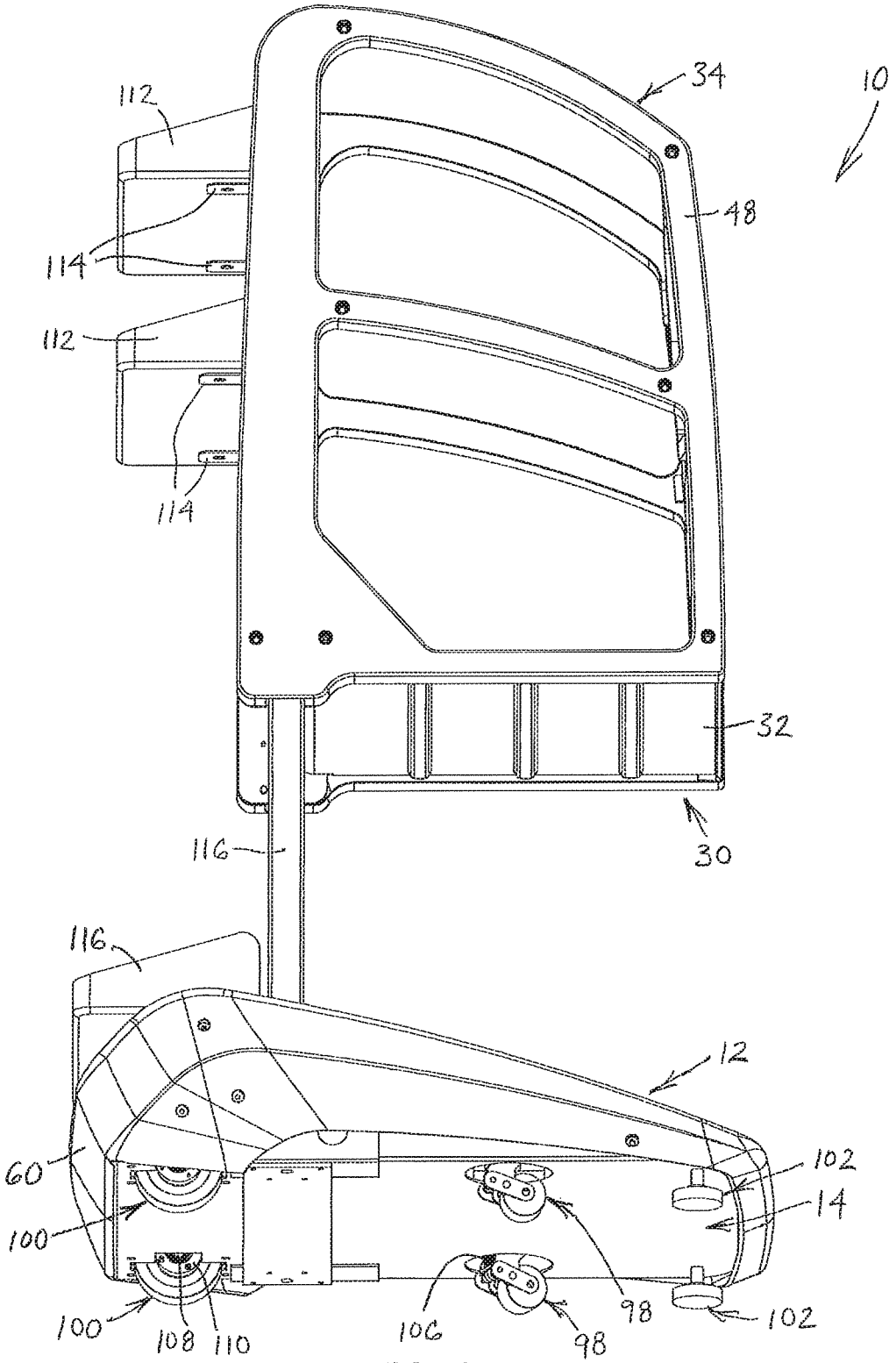
FIG. 12 is a lower left perspective view of the base assembly of the device of FIG. 4, showing the wheel and leg assemblies.
Figure 13:
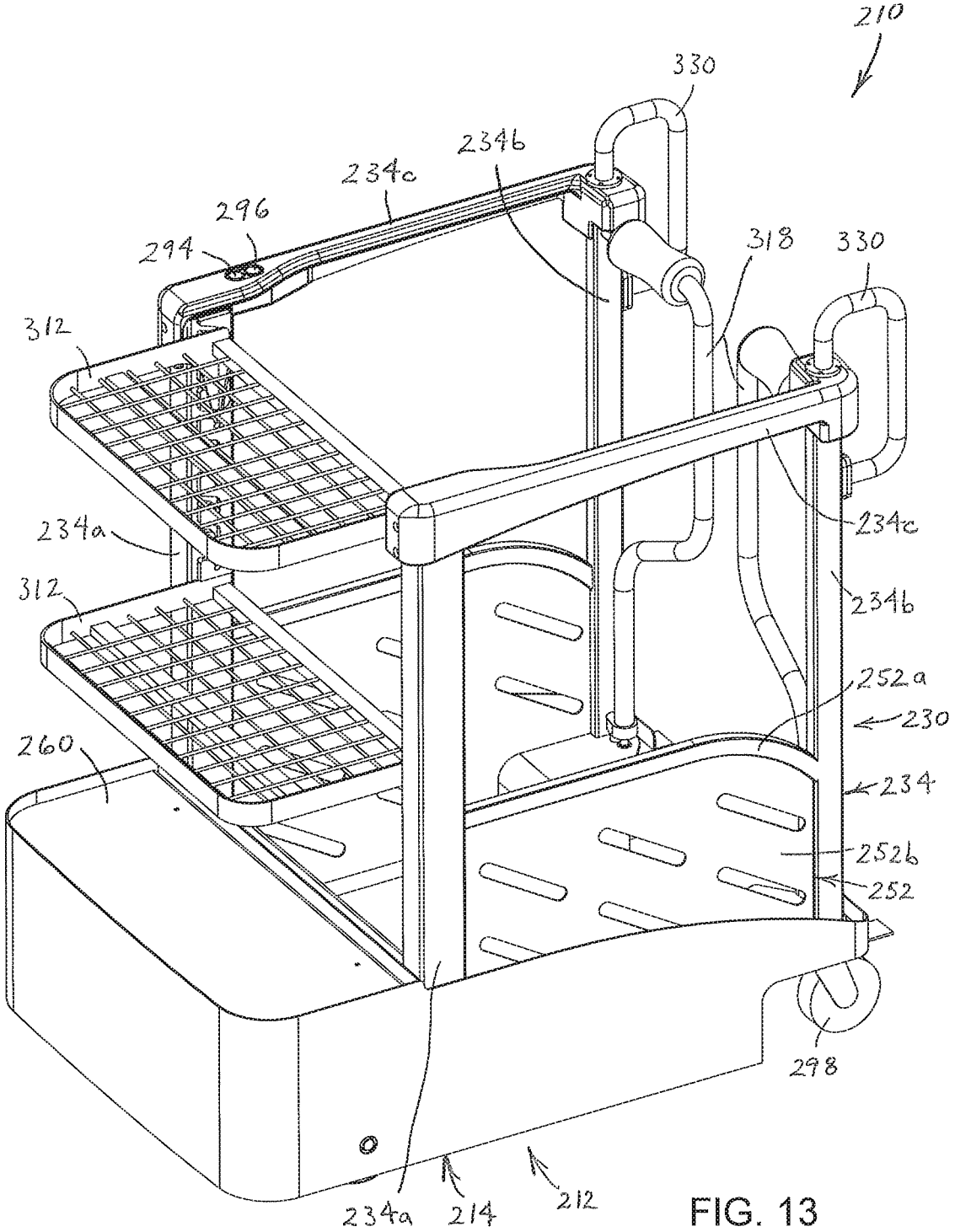
FIG. 13 is a left front perspective view of a second example electric personnel lift device having a height adjustable platform assembly in a lowered position.

As may best be appreciated from FIGS. 3 and 12, the plurality of wheel assemblies 98, 100 extending downward from the base assembly 14 include at least one wheel assembly 98 that biases the base assembly 14 to a first position wherein the at least one foot 102 is in a raised position, and wherein the base assembly 14 is movable from the first position to a second position wherein the at least one foot 102 is lowered to a grounded position. The first example electric personnel lift device 10 shown includes two wheel assemblies 98 are located near a central portion of the base assembly 12 and each includes at least one spring 106 that assists in biasing the base assembly 14 upward, such that the feet 102 are above the ground surface when the electric personnel lift device 10 is at rest and not engaged by an operator or any other load. When an operator steps onto the operator platform 32, the force overcomes the biasing by the wheel assemblies 98 and the feet 102 at near the rear portion of the base assembly 12 move downward to engage the ground. In this sense, the base assembly 12 provides for automatic parking or braking when an operator simply steps onto the operator platform 32.

In the example shown, the plurality of wheel assemblies further includes at least two wheel assemblies 100 that rotate about a fixed axis of rotation because they simply include axles 108 having bearing supports 110 that do not move. The two wheel assemblies 100 that rotate about a fixed axis of rotation are located proximate a front portion of the base assembly 12.

For convenience in holding objects when lifting them up to be shelved or when retrieving them during order picking, the height adjustable platform assembly 30 of the electric personnel lift device 10 includes at least one shelf 112. As may be appreciated by FIGS. 4 and 12, the first example shown includes two shelves 112 supported by mounting tabs 114 of the upper cross members 52 that are connected to the handrail assemblies 34. For additional capacity, as seen in FIGS. 1 and 4, the base assembly 12 may further include at least one shelf 116. Given the hidden and strategically placed lift structures, the electric personnel lift device 10 provides a large, unobstructed operator platform 32, as well as ample, conveniently located shelving and storage areas 112, 116.

Additional safety is provided by having gates 118 pivotally connected to the handrail assemblies 34 at the rear of the height adjustable platform assembly 30. The gates are connected to spring biased hinges 120, which permit pivoting forward, but move back to the original position when released, and do not permit pivoting rearward. Thus, an operator may conveniently press the gates 118 forward while stepping onto the operator platform 32, and once released, the gates 118 will close, blocking exit from the height adjustable platform assembly 30. To exit, the operator must pull the gates 118 forward and swing them outward toward the handrail assemblies 34, and then walk between the gates 118 to step off of the operator platform 32. This gate structure provides convenient, intuitive use of the safety gates 118.

Turning now to FIGS. 13-33, a second example electric personnel lift device 210 is illustrated. The second example electric personnel lift device 210 includes a base assembly 212 having a frame 214 and two columns 216 that are laterally spaced apart and connected to the frame 214. Each column 216 is hollow and may be connected to the frame 214, for example, by being fixedly connected to a bracket 218, such as by welding, as may be best seen in FIGS. 18 and 18D. The bracket 218 may, in turn, be connected to the frame 214, such as by being removably connected to the frame 214 by welding, by fasteners, such as bolts, or by other suitable means of fastening. It also will be appreciated that there may be other suitable ways of connecting the columns to the frame.

Figure 18:
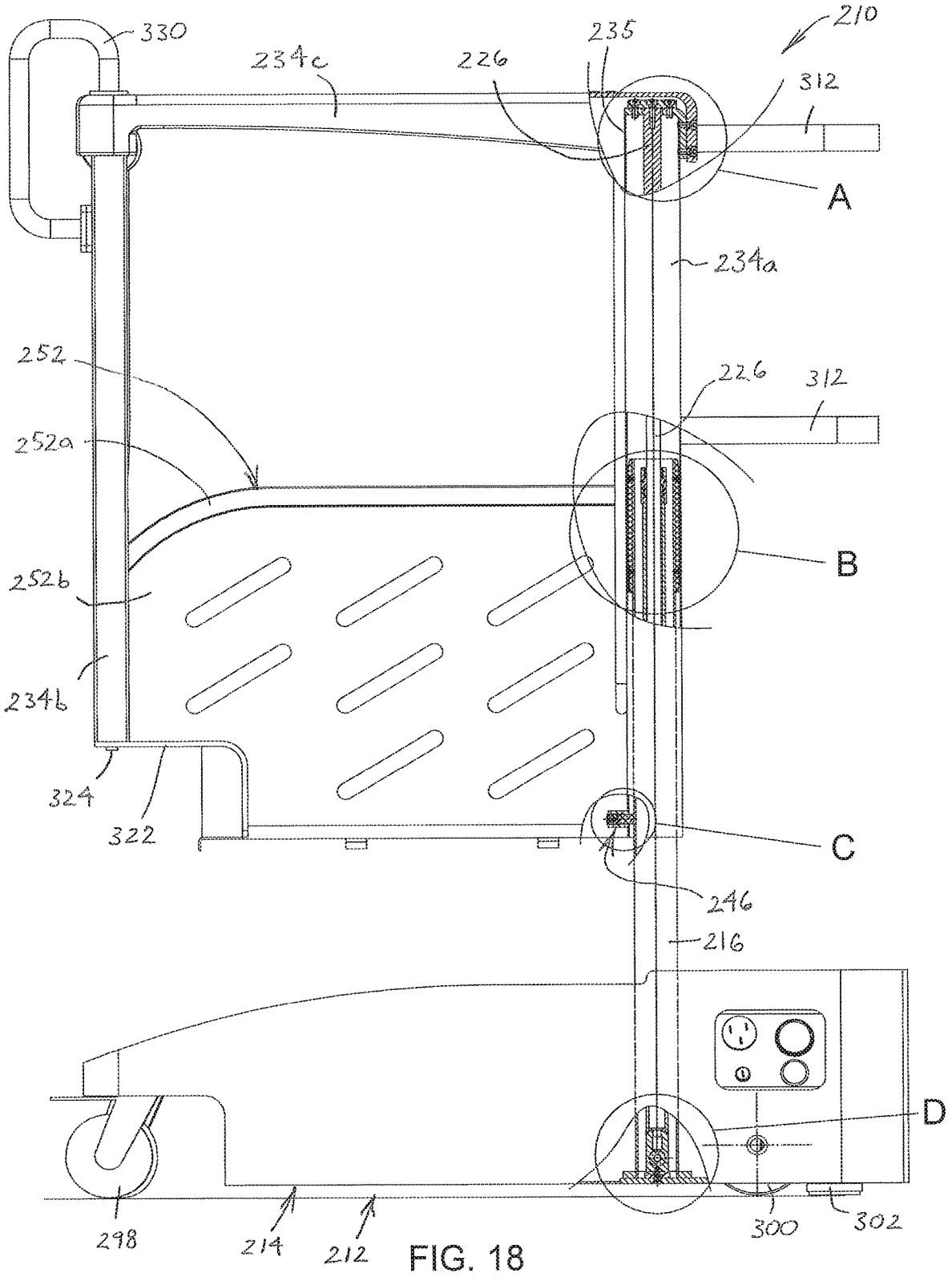
FIG. 18 is a right side partial cross section view of the device of FIG. 13, in a partially raised position and including detail callout partial section views that focus on specific structural features.
Figure 18A:
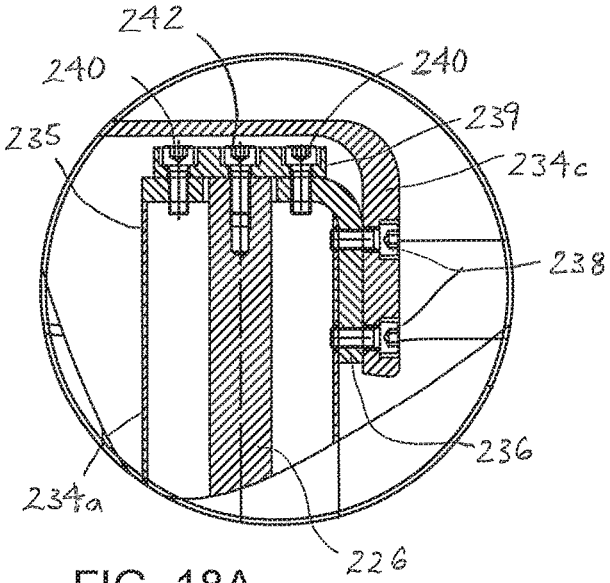
FIG. 18A is an enlarged detail callout partial cross section view featuring the connection of a piston rod and an upper rail to the upper end of the forward upward extending portion of the handrail assembly of the height adjustable platform assembly of the device of FIG. 13.
Figure 18C:
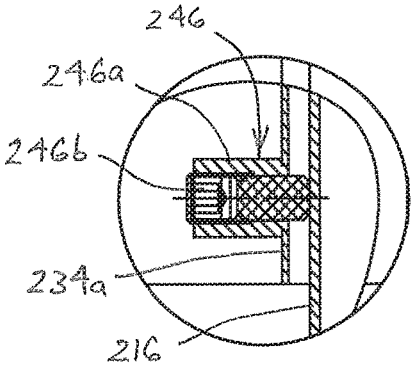
FIG. 18C is an enlarged detail callout partial cross section view featuring a thrust bearing at the lower end of the forward upward extending portion of the handrail assembly of the height adjustable platform of the device of FIG. 13.
Figure 18B:
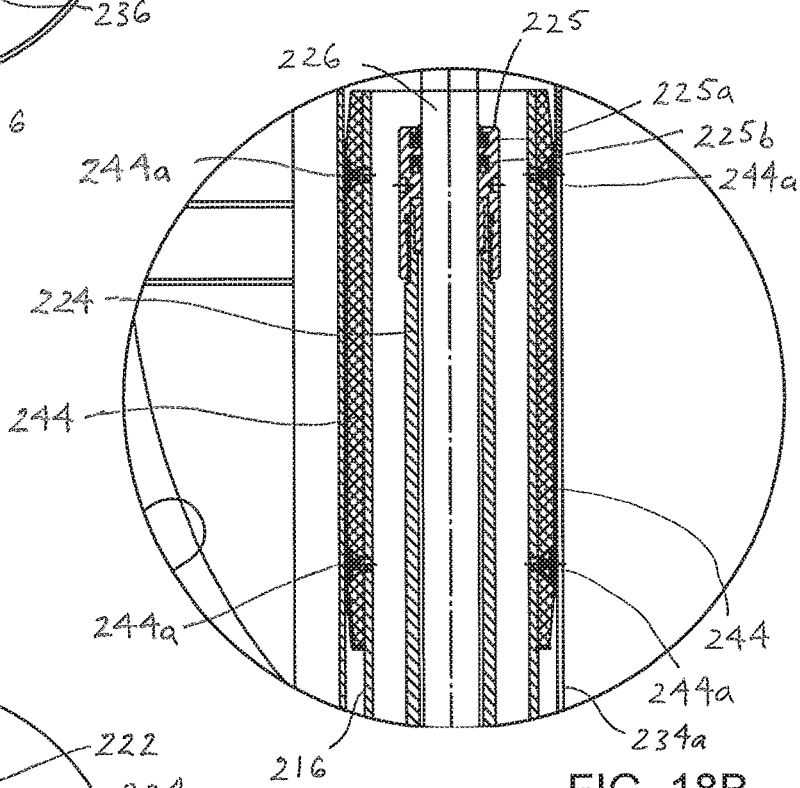
FIG. 18B is an enlarged detail callout partial cross section view featuring the upper end of a column extending upward from the base assembly of the device of FIG. 13.
Figure 18D:
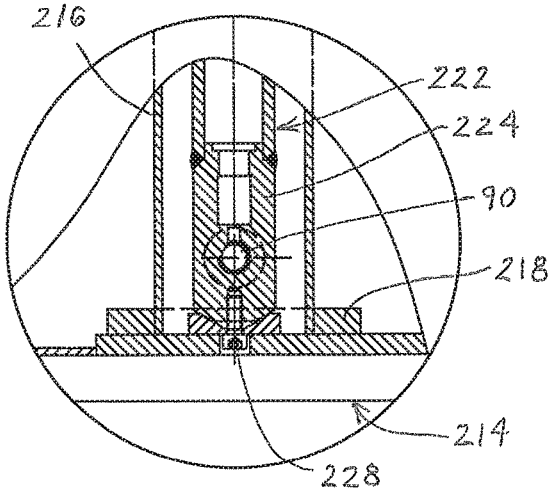
FIG. 18D is an enlarged detail callout partial cross section view featuring the connection of the lift cylinder device and column to the base assembly of the device of FIG. 13.

Each of the two columns 216 has a lift cylinder device 222 located in the respective column 216 and extending upward, as may be best appreciated in FIGS. 18, 18B and 18D. Each lift cylinder device 222 includes a lower cylinder 224 and a movable piston rod 226 that is further extendible upward. As best seen in FIG. 18B, a threaded collar 225 engages complementary threads on the upper end of the lower cylinder 224. The collar 225 includes a wiper seal 225*a* and pressure seal 225*b*. In this second example, each lift cylinder also is removably connected to one of the brackets 218 by a fastener 228, although it will be appreciated that other suitable means of connection to the bracket 218, column 216 and ultimately the frame 214 of the base assembly 212 may be utilized.

Figure 14:
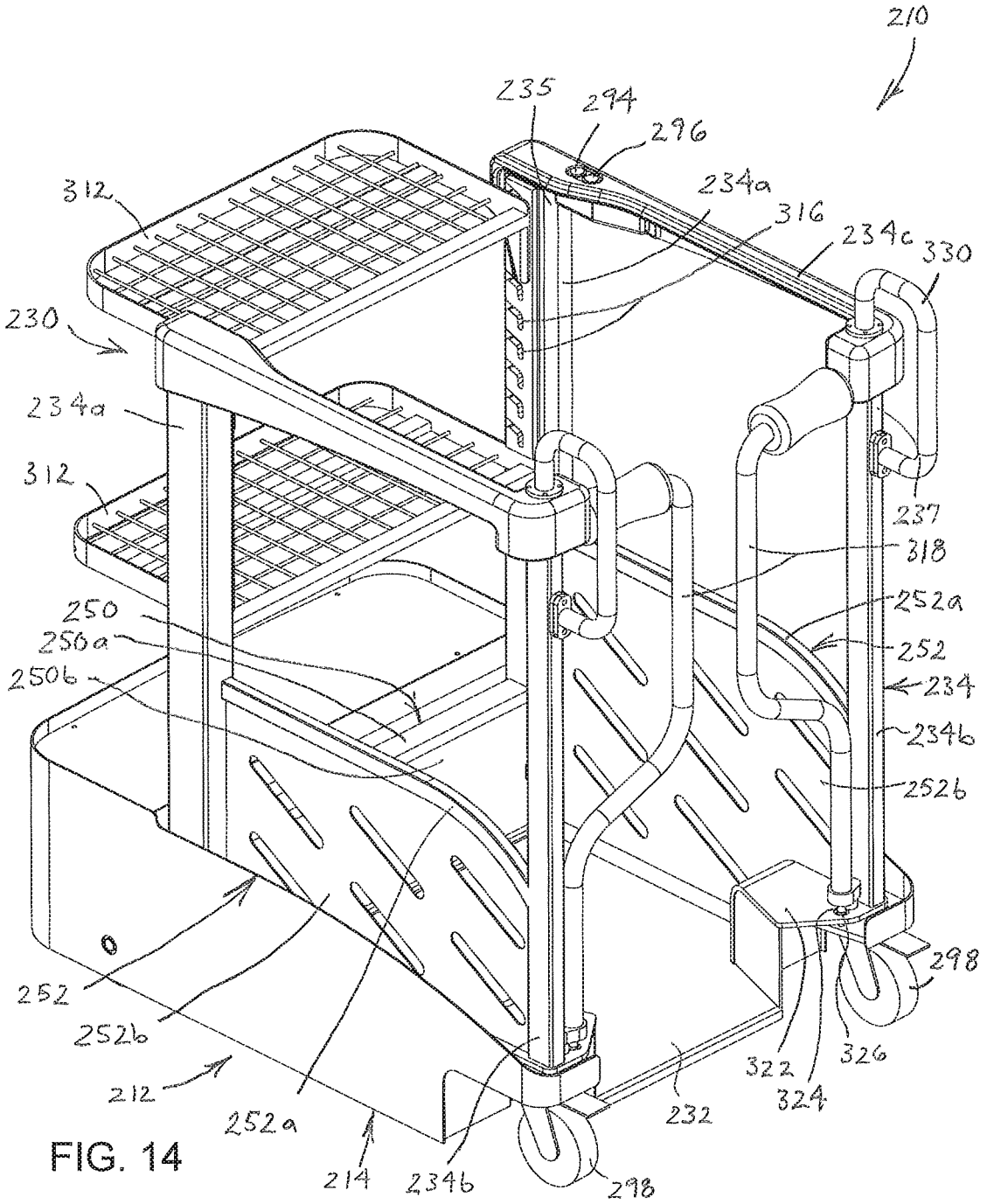
FIG. 14 is a left rear perspective view of the device of FIG. 13.
Figure 15:
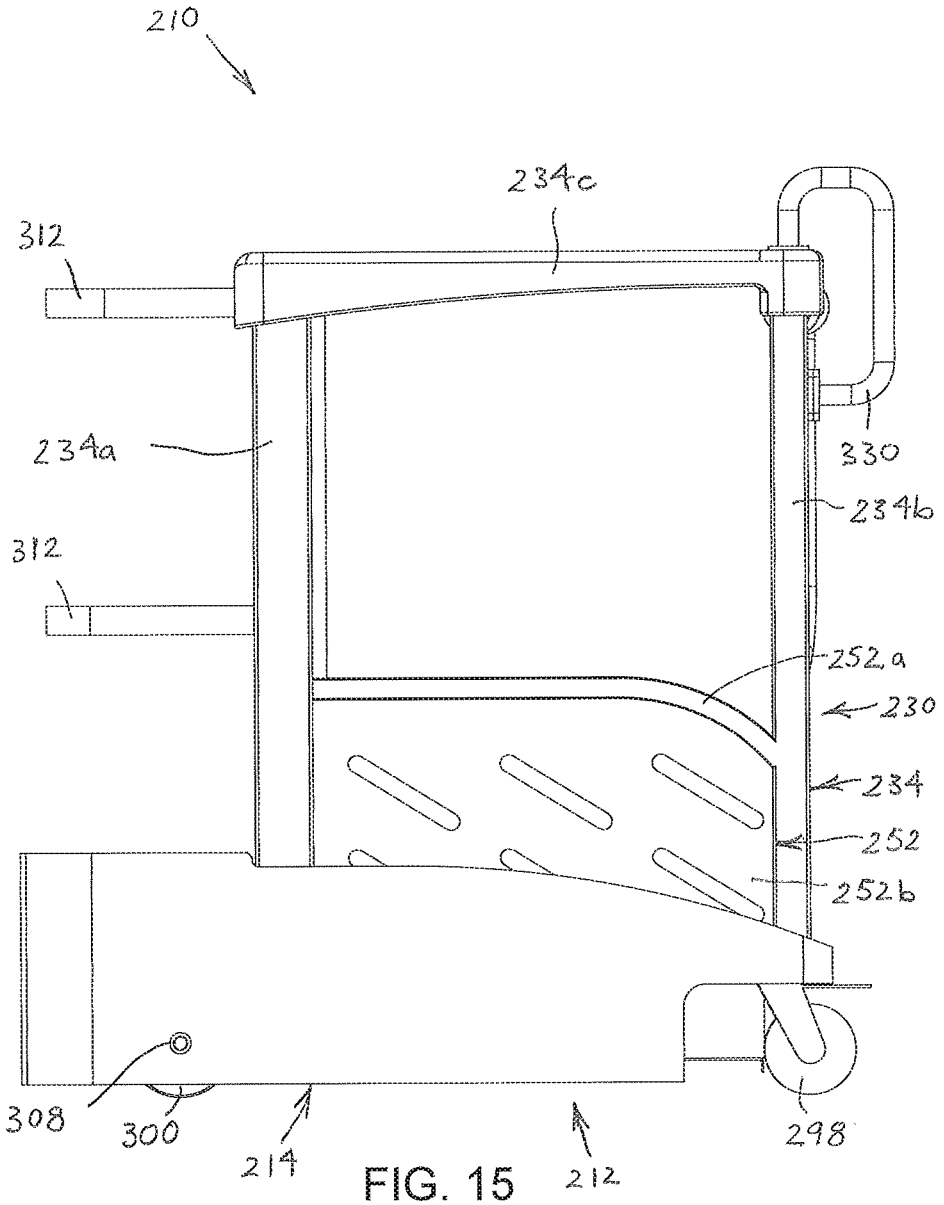
FIG. 15 is a left side plan view of the device of FIG. 13.
Figure 16:
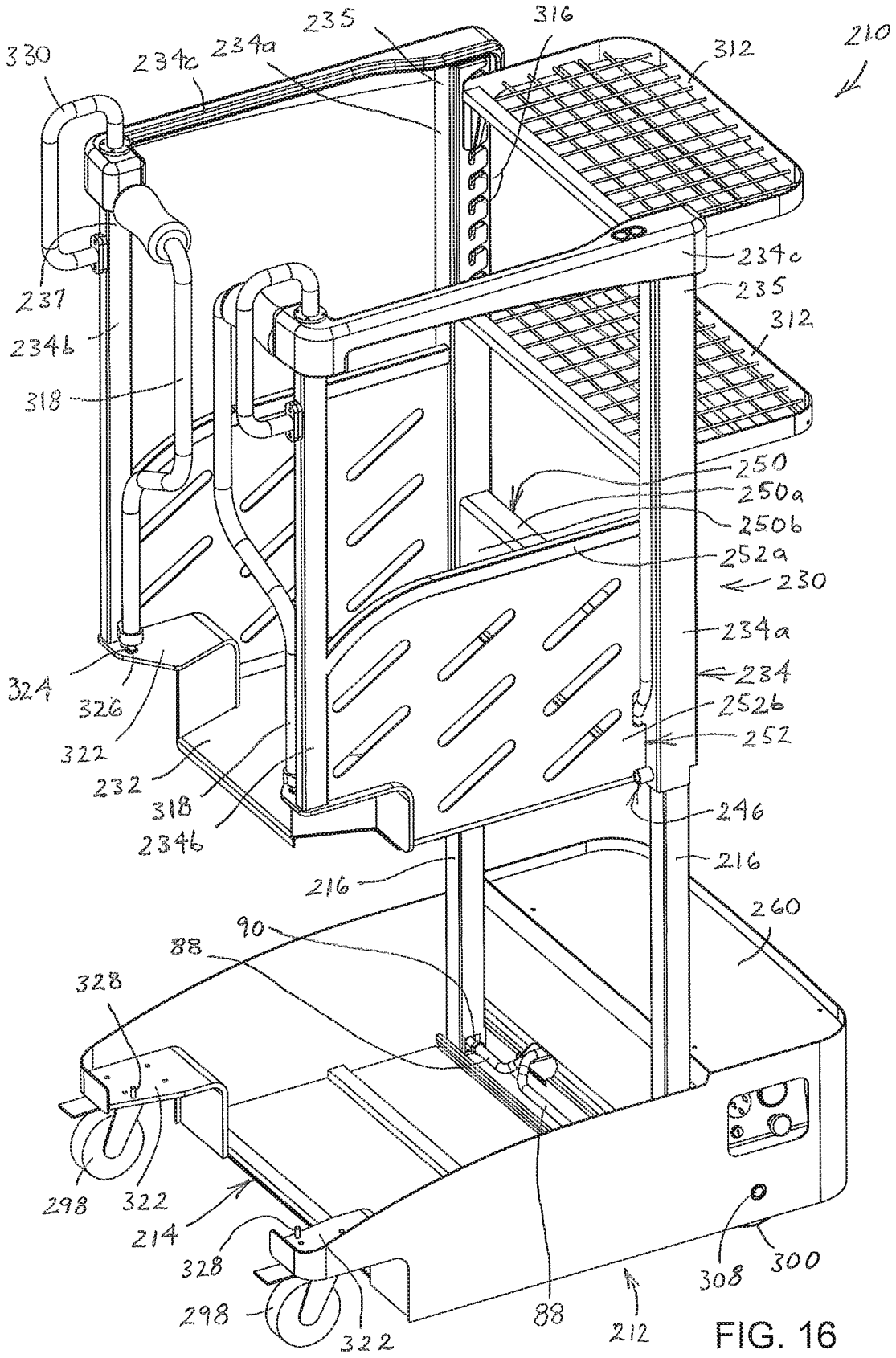
FIG. 16 is a right rear perspective view of the example device of FIG. 13 having the height adjustable platform assembly in a raised position.
Figure 20:
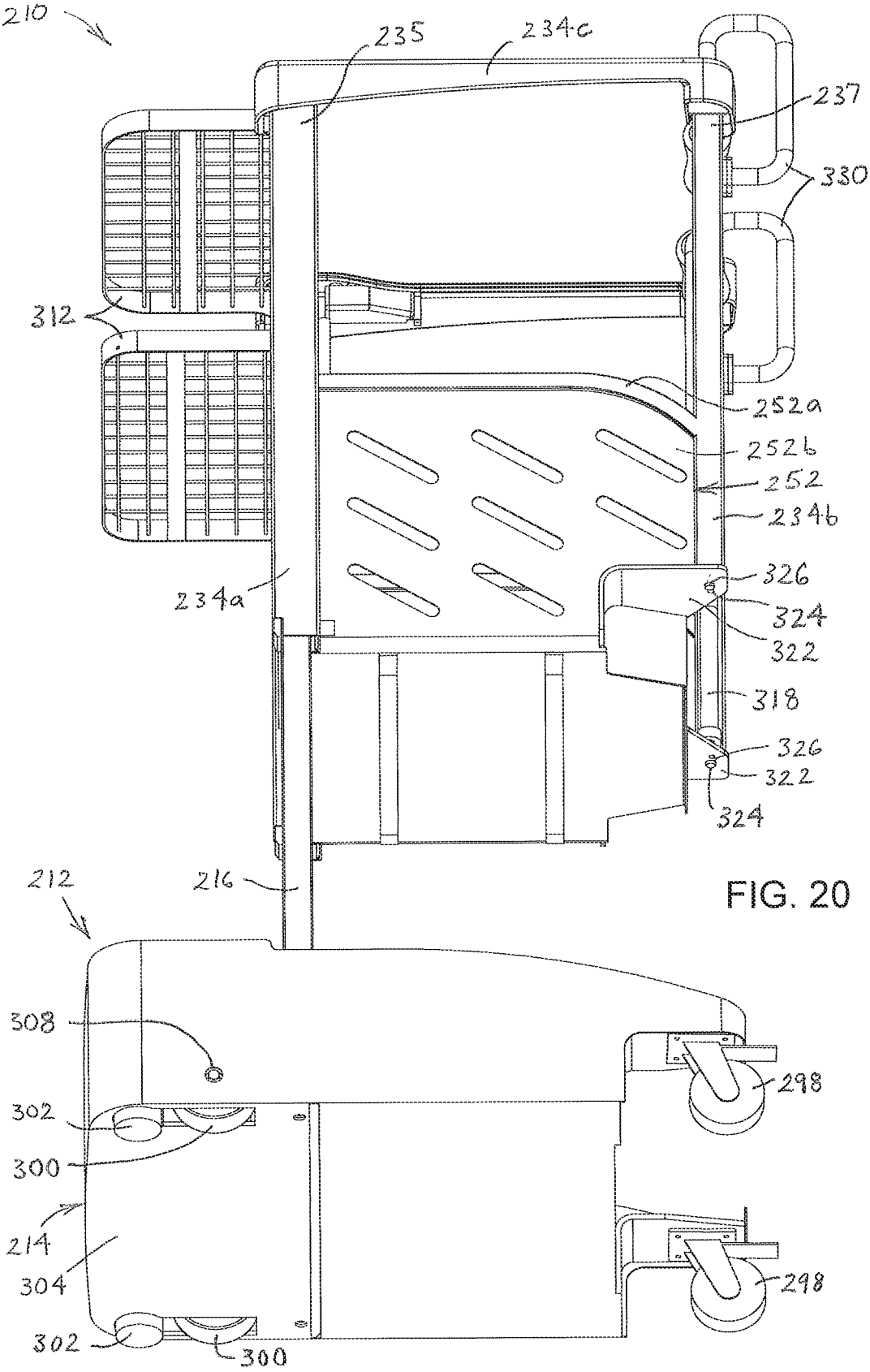
FIG. 20 is a left lower perspective view of the device of FIG. 13 having the height adjustable platform assembly in a raised position.

A height adjustable platform assembly 230 is movable between at least a lowered position, seen for example in FIGS. 13-15 and 27-31, and a raised position, seen for example in FIGS. 16, 18 and 20. The height adjustable platform assembly 230 has an operator platform 232 and two laterally spaced apart handrail assemblies 234 connected to and extending upward from the operator platform 232. In this second example, the handrail assemblies 234 include a pair of forward upward extending portions 234*a*, a pair of rearward upward extending portions 234*b*, and a pair of upper handrail portions 234*c*, each of which is connected to an upper end 235 of a forward upward extending portion 234*a* and an upper end 237 of a rearward upward extending portion 234*b*, respectively. When the height adjustable platform assembly 230 is in the lowered position, the operator platform 232 is adjacent the frame 214 of the base assembly 12.

Figure 17:
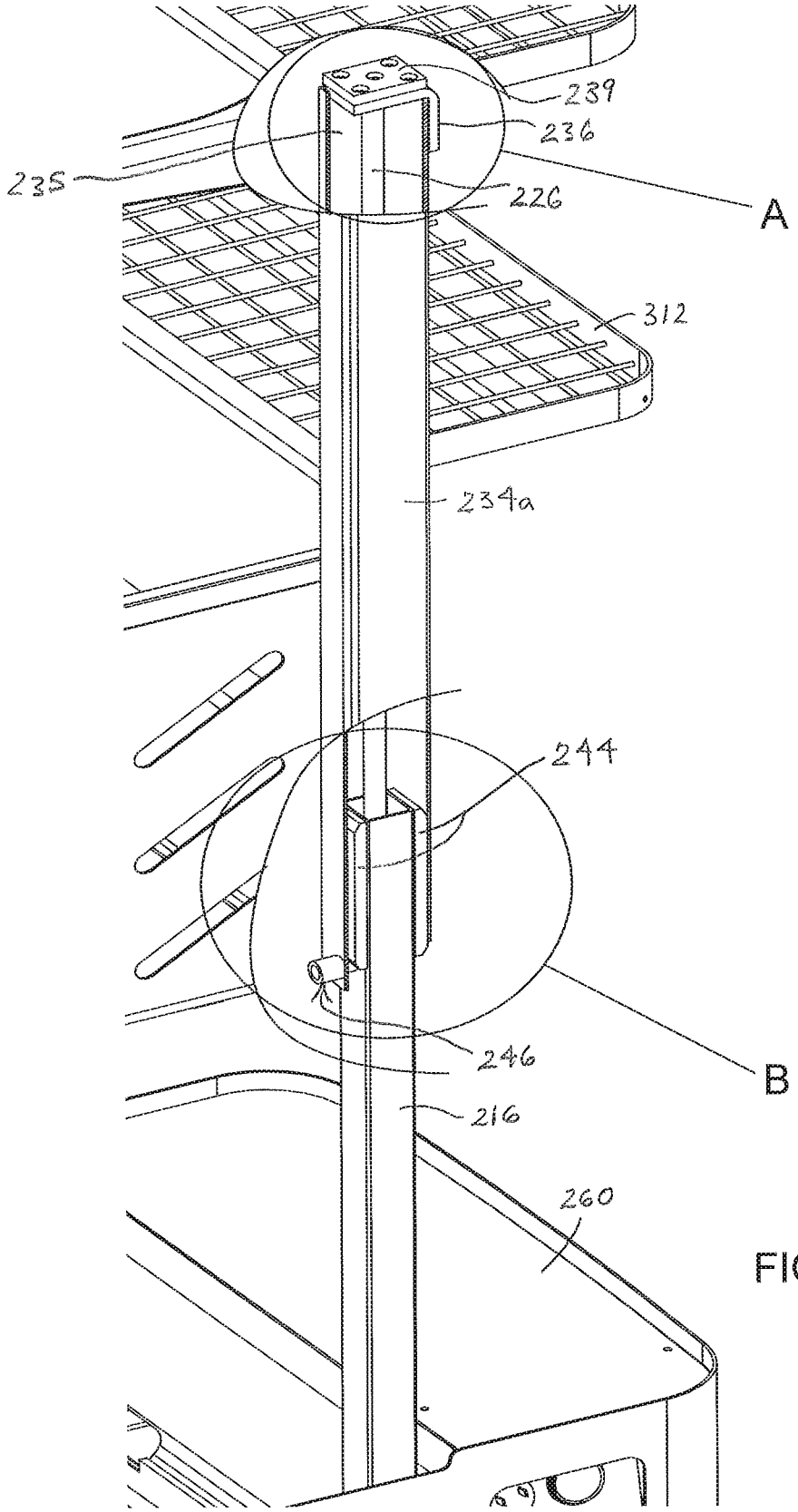
FIG. 17 is an enlarged right rear perspective partial cross section view of a forward upward extending portion of a handrail assembly of the height adjustable platform assembly of the device of FIG. 13, in a fully raised position and including detail callout partial cross section views that focus on specific structural features.
Figure 17A:
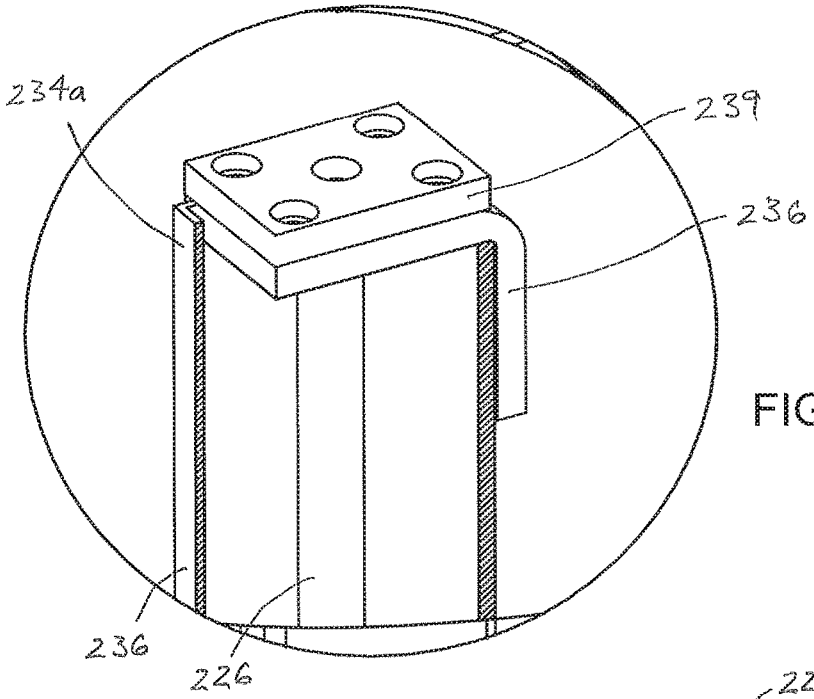
FIG. 17A is an enlarged detail callout partial cross section view featuring a mounting bracket at the upper end of the forward upward extending portion of a handrail assembly of the height adjustable platform assembly of the device of FIG. 13.
Figure 17B:
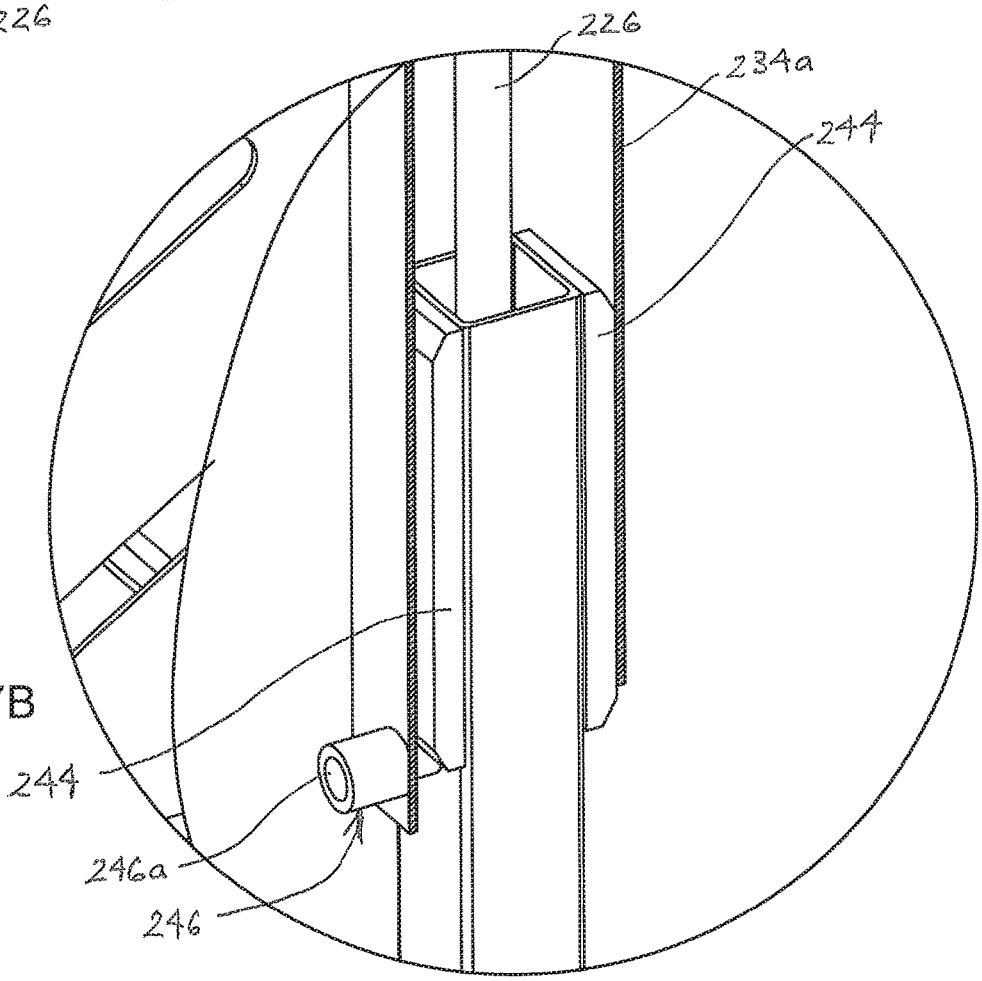
FIG. 17B is an enlarged detail callout partial cross section view featuring a lower end of the forward upward extending portion of the handrail assembly of the height adjustable platform assembly of the device of FIG. 13.

As may be seen in FIGS. 17, 17, 18 and 18A, each upper handrail portion 234*c* of the height adjustable platform assembly 230 of the second example is connected to a bracket 236 at the upper end of a forward upward extending portion 234*a*, such as by use of fasteners 238. A mounting plate 239 is connected to each bracket 236, such as by fasteners 240. The mounting plate portion 239 then is connected to an upper end of a movable piston rod 226 of each lift cylinder device 222, such as by use of a fastener 242.

As may be seen in FIGS. 17, 17B, 18 and 18B, the pair of forward upward extending portions 234*a* is slidably coupled to the pair of columns 216, respectively. For example, a pair of bushings 244 are connected to fore and aft sides of the columns 216. The bushings 244 may be constructed as a friction reducing pads, rollers or any other suitable structures to provide for smooth slidable engagement. Each bushing 244 may be connected to a column 216 via fasteners 244*a*, such as screws, or may be connected using adhesive or other suitable means of connection.

Figure 19:
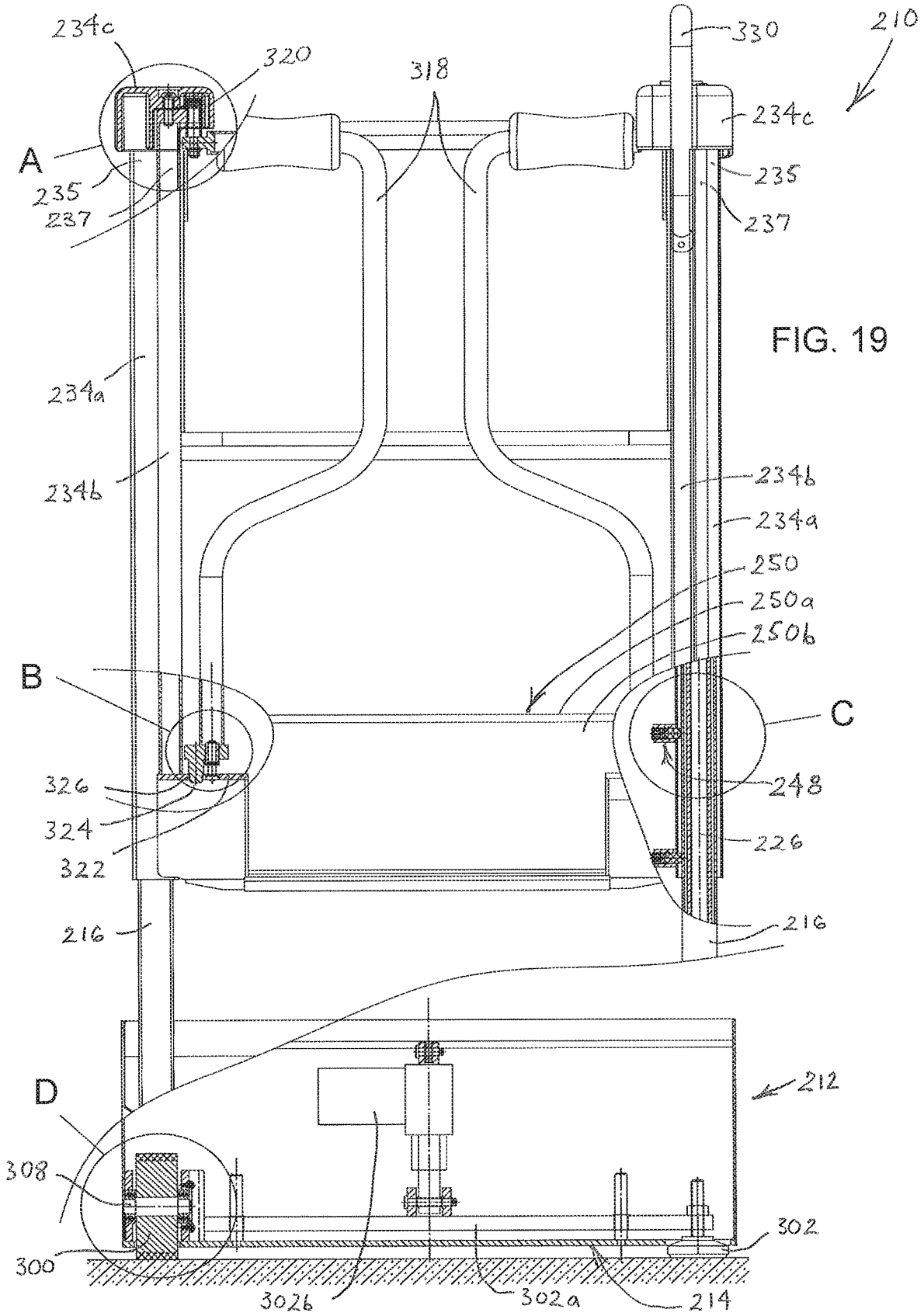
FIG. 19 is a rear partial cross section view of the device of FIG. 13, in a partially raised position and including detail callout partial section views that focus on specific structural features.
Figure 19A:
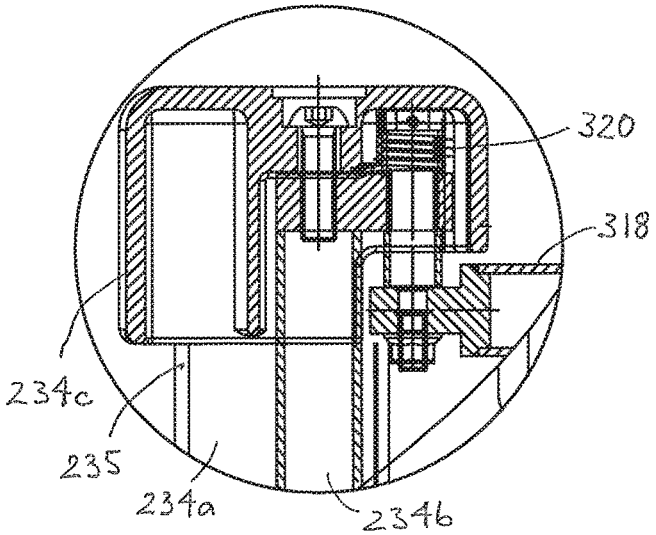
FIG. 19A is an enlarged detail callout rear partial cross section view featuring the connection of the upper end of a pivotal rear gate to an upper rail of the handrail assembly of the height adjustable platform assembly of the device of FIG. 13.
Figure 19B:
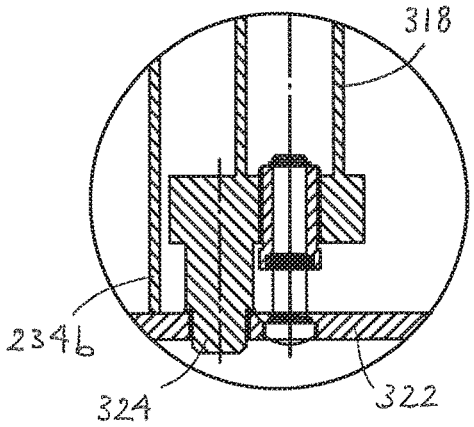
FIG. 19B is an enlarged detail callout rear partial cross section view featuring the connection of the lower end of the pivotal rear gate to the height adjustable platform assembly of the device of FIG. 13.
Figure 19C:
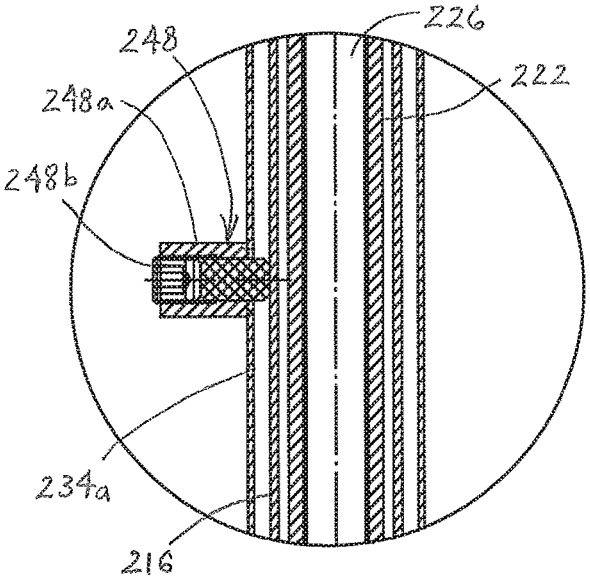
FIG. 19C is an enlarged detail callout rear partial cross section view featuring a thrust bearing at the lower end of the forward upward extending portion of the handrail assembly of the height adjustable platform of the device of FIG. 13.
Figure 19D:
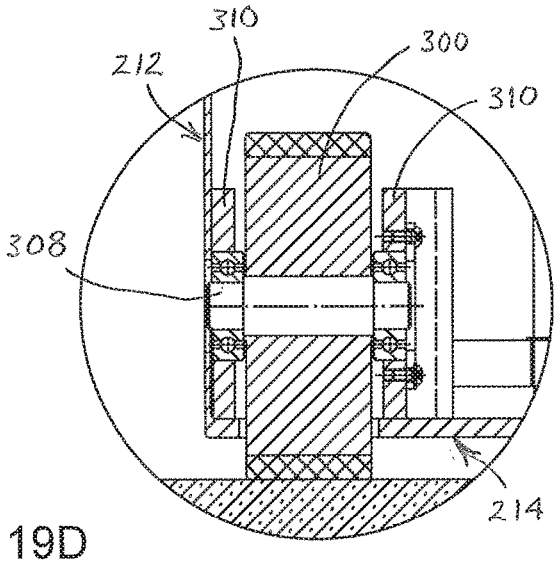
FIG. 19D is an enlarged detail callout rear partial cross section view featuring the connection of a front wheel to the base assembly of the device of FIG. 13.

To help reduce potential fore and aft play in the slidable coupling of the forward upward extending portions 234*a* to the columns 216, an adjustable bushing 246 is provided near the bottom of the rear side of each forward upward extending portion 234*a*. As may be seen in further detail in FIGS. 18 and 18C, each adjustable bushing 246 may include a threaded collar 246*a* connected to a forward upward extending portion 234*a* and a complementary threaded thrust plug 246*b* that may be advanced in the collar 246*a* to contact the column 216 to reduce play. Similarly, to help reduce potential side-to-side play in the slidable connection of the forward upward extending portions 234*a* and columns 216, at least one adjustable bushing 248 is provided near the bottom of the inner side of each forward upward extending portion 234*a*. In this second example, two such adjustable bushings 248 are provided. As may be seen in further detail in FIGS. 19 and 19C, each adjustable bushing 248 may be similar to the adjustable bushings 246. Thus, each adjustable bushing 248 includes a threaded collar 248*a* connected to a forward upward extending portion 234*a* and a complementary threaded thrust plug 248*b* that may be advanced in the collar 248*a* to contact the column 216 to reduce play. To reduce binding, the thrust plugs 246*b* and 248*b* may include a hemispherical front, a ball bearing within a forward facing socket, a pad or other friction reducing structure.

As best seen in FIGS. 14 and 15, the height adjustable platform assembly 230 includes a front cross member 250 that is fixedly connected to the two forward upward extending portions 234*a*. In this second example, the front cross member 250 includes at least a rail 250*a* and a panel 250*b* that help to keep the operator safely within the height adjustable platform assembly 230. Somewhat similarly, the height adjustable platform assembly 230 includes side members 252, with each side member being fixedly connected to a forward upward extending portion 234*a* and a rearward upward extending portion 234*b*. The side members 252 include at least a rail 252*a* and a panel 252*b* that helps to keep the operator safely within the height adjustable platform assembly 230.

Figure 21:
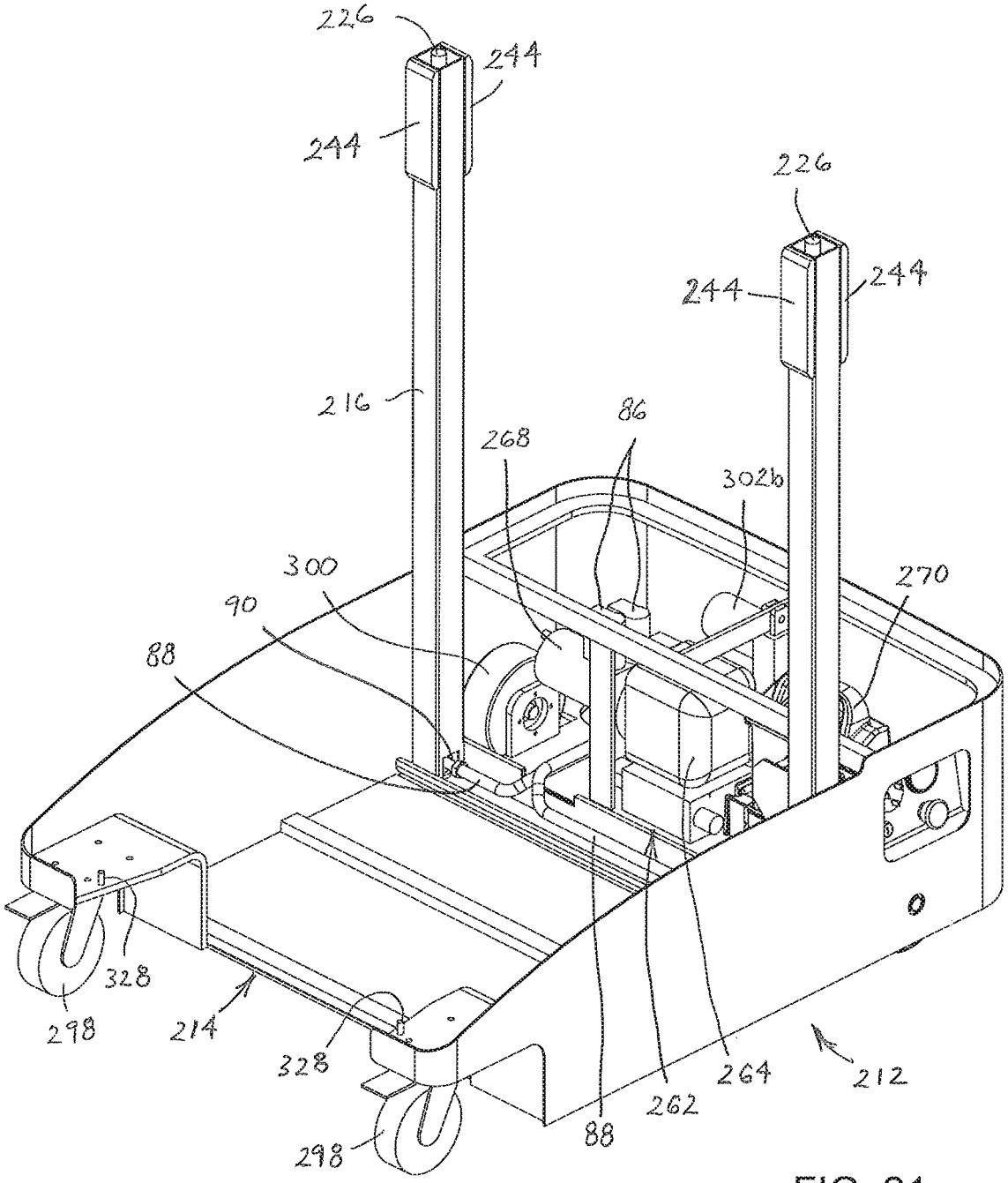
FIG. 21 is a right rear perspective view of the base assembly of the device of FIG. 13.
Figure 22:
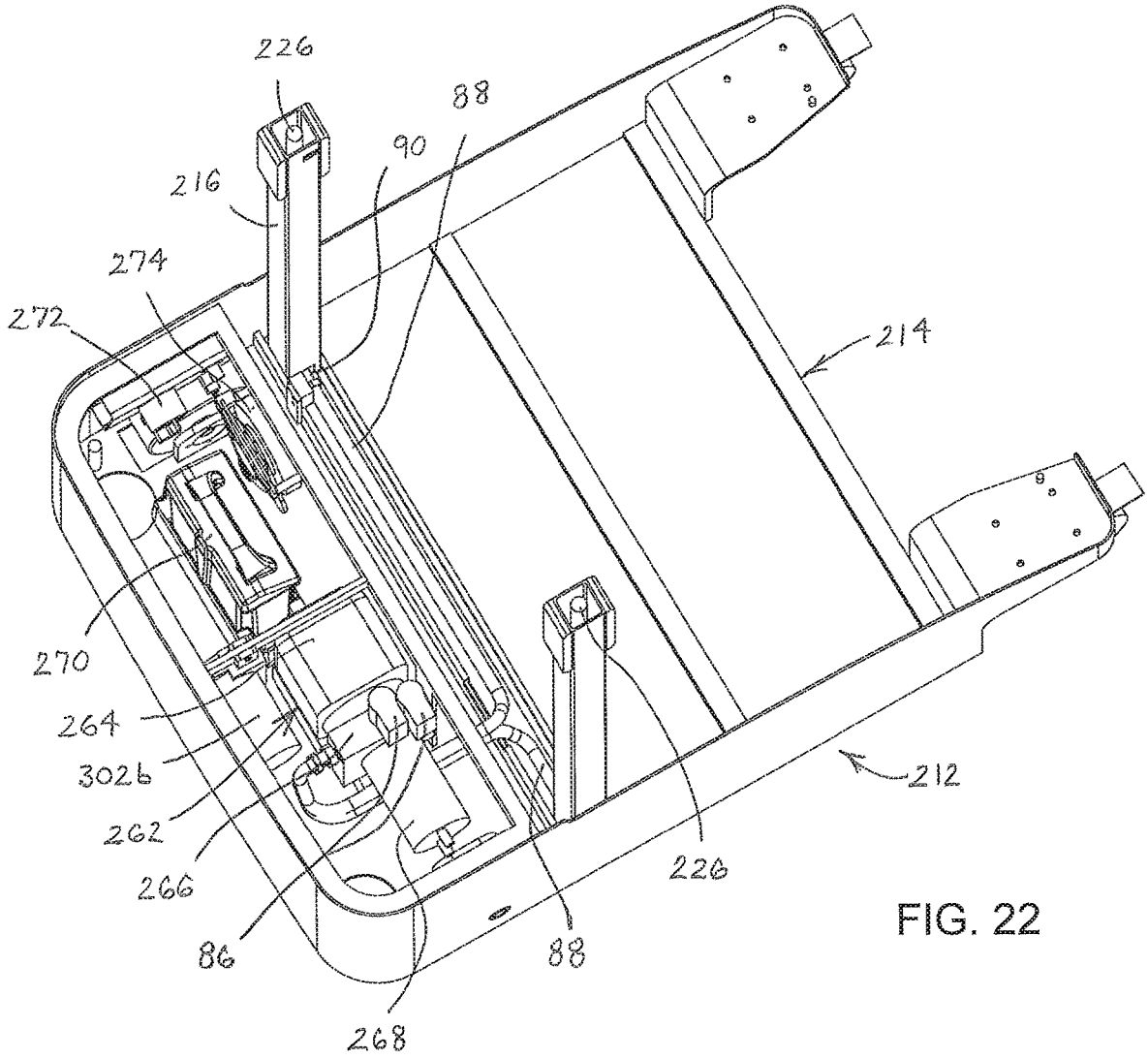
FIG. 22 is a left front upper perspective view of the base assembly of the device of FIG. 13.
Figure 23:
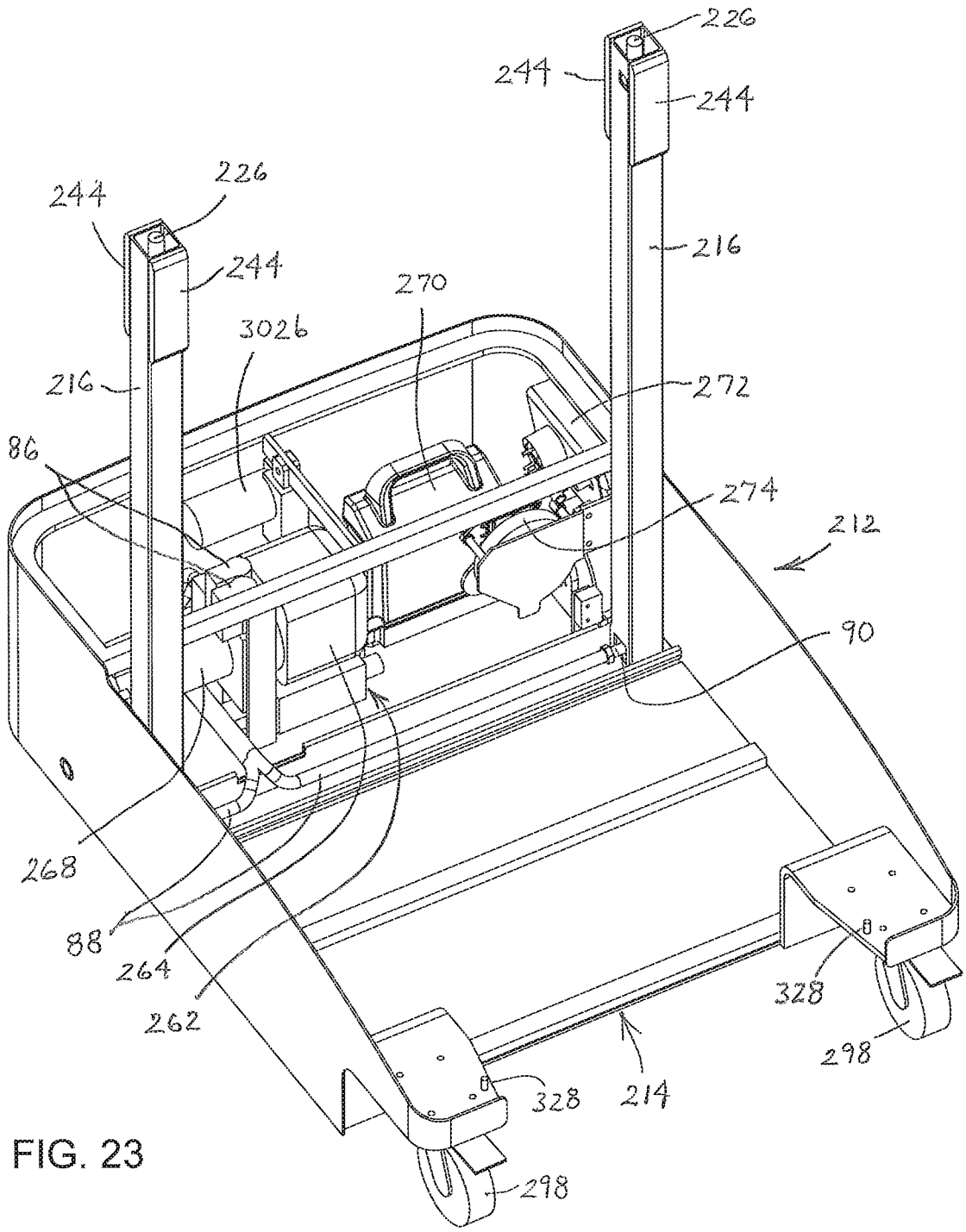
FIG. 23 is a left rear upper perspective view of the base assembly of the device of FIG. 13.

The base assembly 212 of the electric personnel lift device 210 is shown in FIGS. 21-23 with a front cover 260 removed to expose internal components that are otherwise protected, and with the wiring and fluid conduits removed for ease of viewing. When installed, as seen in FIGS. 13, 14, 16, 27 and 28, the cover 260 also serves as a shelf. In FIGS. 21-23, one may see a hydraulic system 262 is mounted within the base assembly 212. The hydraulic system includes a fluid reservoir 264, a hydraulic pump, which is concealed by the reservoir 264, and an electric hydraulic valve 266. The hydraulic system 262 further includes an electric motor 268 to drive the hydraulic pump. A power source 270 is provided for the electric motor 268. In this second example electric personnel lift device 210, the power source 270 includes a rechargeable battery. The base assembly 212 also houses a battery charger 272, with a reel device 274, which provides a retractable cord (not shown) for convenient on-board charging of the rechargeable battery 270. These features provide further convenience to the user and avoid having to remove a battery for charging.

The hydraulic system 262 further includes essentially the same fluid circuit 76, a schematic view of which is shown in FIG. 10, for fluid connection of the pump and reservoir 264 to the lift cylinder devices 222. The description of the fluid circuit 76 from the first example adequately describes the system for the second example, as well. Thus, a main conduit 78 extends from the reservoir 264 and valve 266 to a splitter body 80. The splitter body 80 divides the fluid flow into two branch conduits 82, which lead to control blocks 84 having further electric hydraulic valves 86. Connecting conduits 88 extend from the control blocks 84 to ports 90 at the bottom of the columns 216 for connection to the lower cylinders 224 of the lift cylinder devices 222, as may be appreciated when viewing FIGS. 16, 18D and 21-23. It will be appreciated that the connections within the fluid circuit 76 and hydraulic system 262 may be by conventional means for simple upward and downward movement of the lift cylinder devices 222. Furthermore, an operator may operate the electric personnel lift device 210 by use of a handheld control device 92, seen in FIG. 11 in the form of a transmitter having simple buttons 94, 96 to send a signal to provide upward and downward movement of the height adjustable platform assembly 30. It will be appreciated that a control device may be mounted on the electric personnel lift device 210, such as is shown with operator buttons 294, 296 on the right handrail assemblies 234*c*, although other locations and controls may be included, if desired.

The base assembly 212 of the electric personnel lift device 210 includes a plurality of wheel assemblies 298, 300, which extend downward to contact a ground surface. In addition, the base assembly 212 includes at least one foot 302, which is capable of providing static support and braking, to prevent rolling of the vehicle. In the example shown, as best seen in FIGS. 18, 19, 20 and 33, the at least one foot 302 includes two adjustable feet 302 located along a lower surface 304 of the base assembly 212 proximate a front portion of the base assembly 212. The two feet 302 are adjustably connected to a crossbar 302*a*, by being threadably engaged with threaded receivers on the crossbar 302*a*, as may be seen in FIG. 19. The crossbar 302*a* ultimately is connected to an electric solenoid 302*b* that can be activated to move the crossbar 302*a* downward to extend the feet 302 to a braking position against a ground surface, or to move the crossbar 302*a* upward to a raised position wherein the feet 302 do not engage the ground surface. When the feet 302 are in the raised position, the electric personnel lift device 210 may be pushed or wheeled to a desired location for use.

As may best be appreciated from FIGS. 15, 18, 19, 20 and 33, the plurality of wheel assemblies 298, 300 extending downward from the base assembly 214 include at least one wheel assembly 298 that is a swivel or caster wheel assembly. In the example shown, two wheel assemblies 298 are located near the rear of the base assembly 212 and connected to the frame 214, and the two wheel assemblies 298 swivel about two spaced apart vertical axes. The base assembly 212 also includes at least one wheel assembly 300 that rotates about a fixed axis of rotation because it simply includes an axle 308 having bearing supports 310 that do not move. As shown in the second example, there are two wheel assemblies 300 that rotate about a fixed axis of rotation and are located proximate a front portion of the base assembly 212. The two wheel assemblies 300 are spaced apart laterally, but rotate about the same fixed horizontal axis of rotation defined by their aligned respective axles 308.

For convenience in holding objects when lifting them up to be shelved or when retrieving them during order picking, the height adjustable platform assembly 30 of the electric personnel lift device 210 includes at least one shelf 312. As may be appreciated in FIGS. 13, 14, 16 and 26-30, the second example shown includes two shelves 312 supported by mounting tabs 314 extending laterally from the shelves 312 and fitting within slots 316 in the forward upward extending portions 234*a*. For additional capacity, as previously mentioned and seen in FIG. 13, the base assembly 212 may further include at least one shelf 260. Given the hidden and strategically placed lift structures for the height adjustable platform assembly 230, the electric personnel lift device 210 provides a large, unobstructed operator platform 232, as well as ample, conveniently located shelving and storage areas 260, 312.

Figure 24:
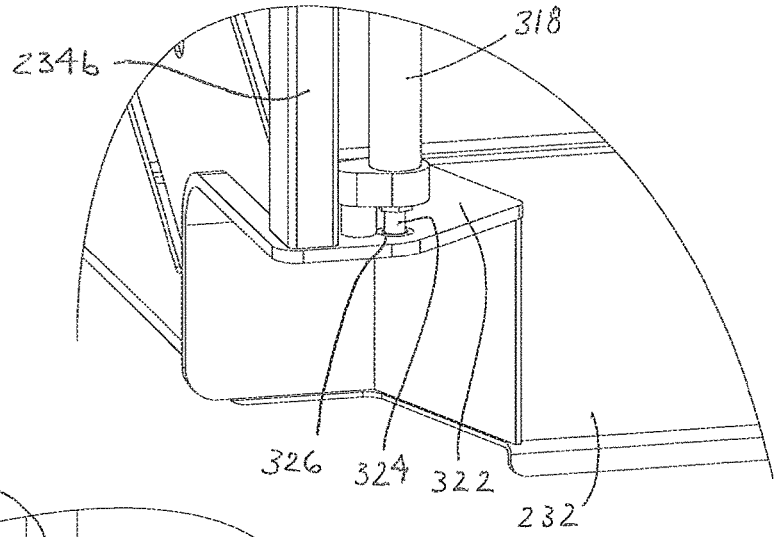
FIG. 24 is a left rear perspective view of the locked position of the lower end of the rear left gate of the device of FIG. 13, when the height adjustable platform assembly is in a raised position.
Figure 25:
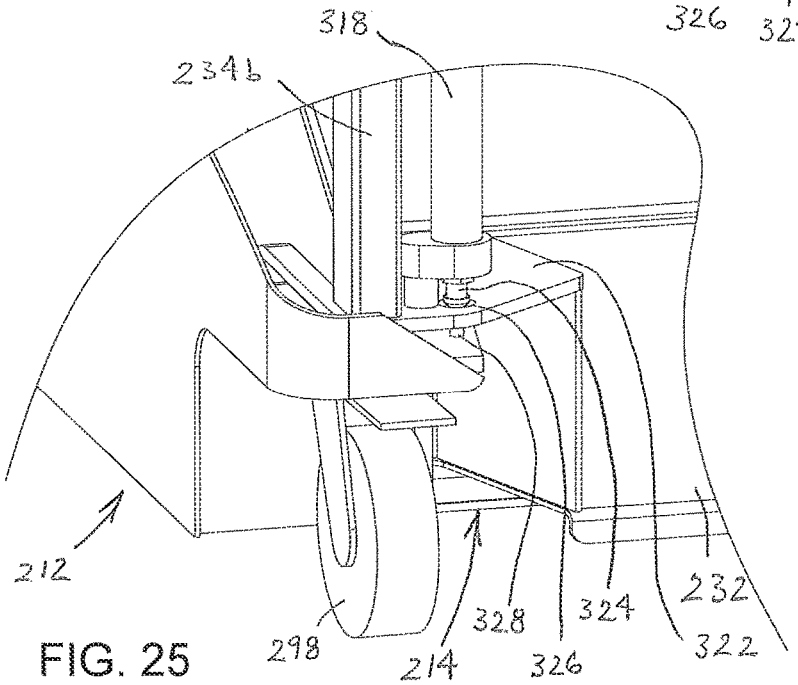
FIG. 25 is a left rear perspective view of the unlocked position of the lower end of the rear left gate of the device of FIG. 13, when the height adjustable platform assembly is in a lowered position.
Figure 26:
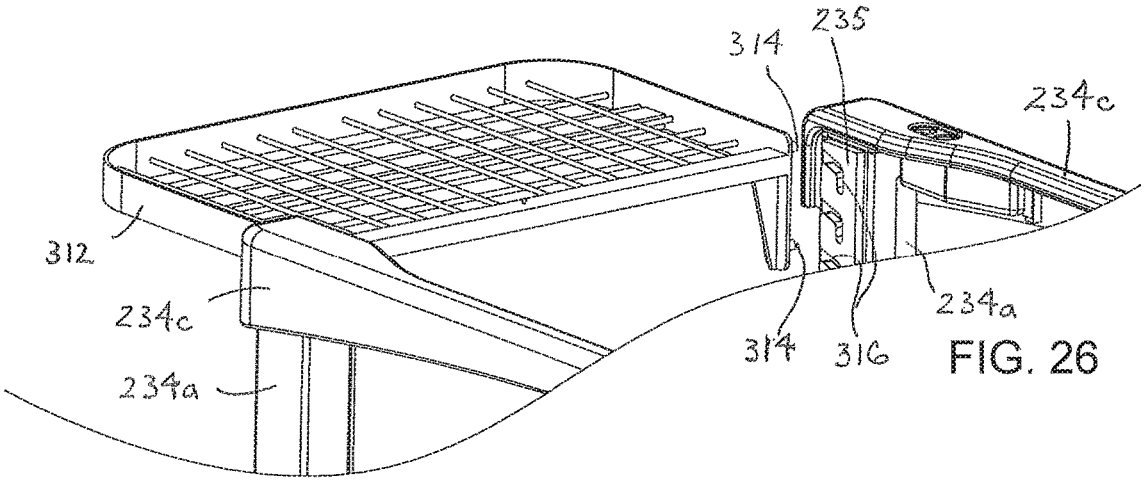
FIG. 26 is a left perspective view of the an upper front shelf removed from the right forward vertical portion of the handrail assembly of the height adjustable platform assembly of the device of FIG. 13.
Figure 27:
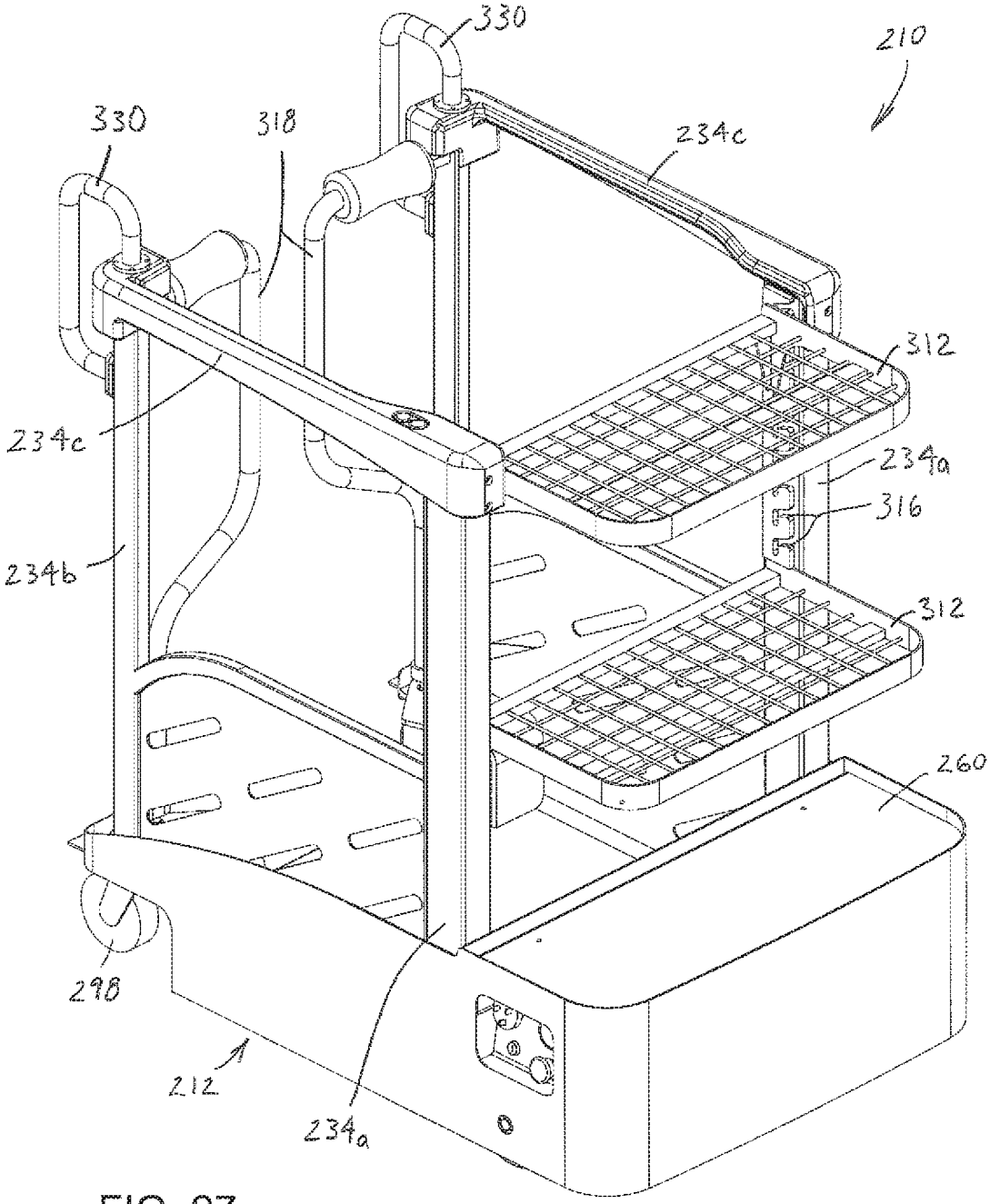
FIG. 27 is a right front perspective view of the device of FIG. 13.
Figure 28:
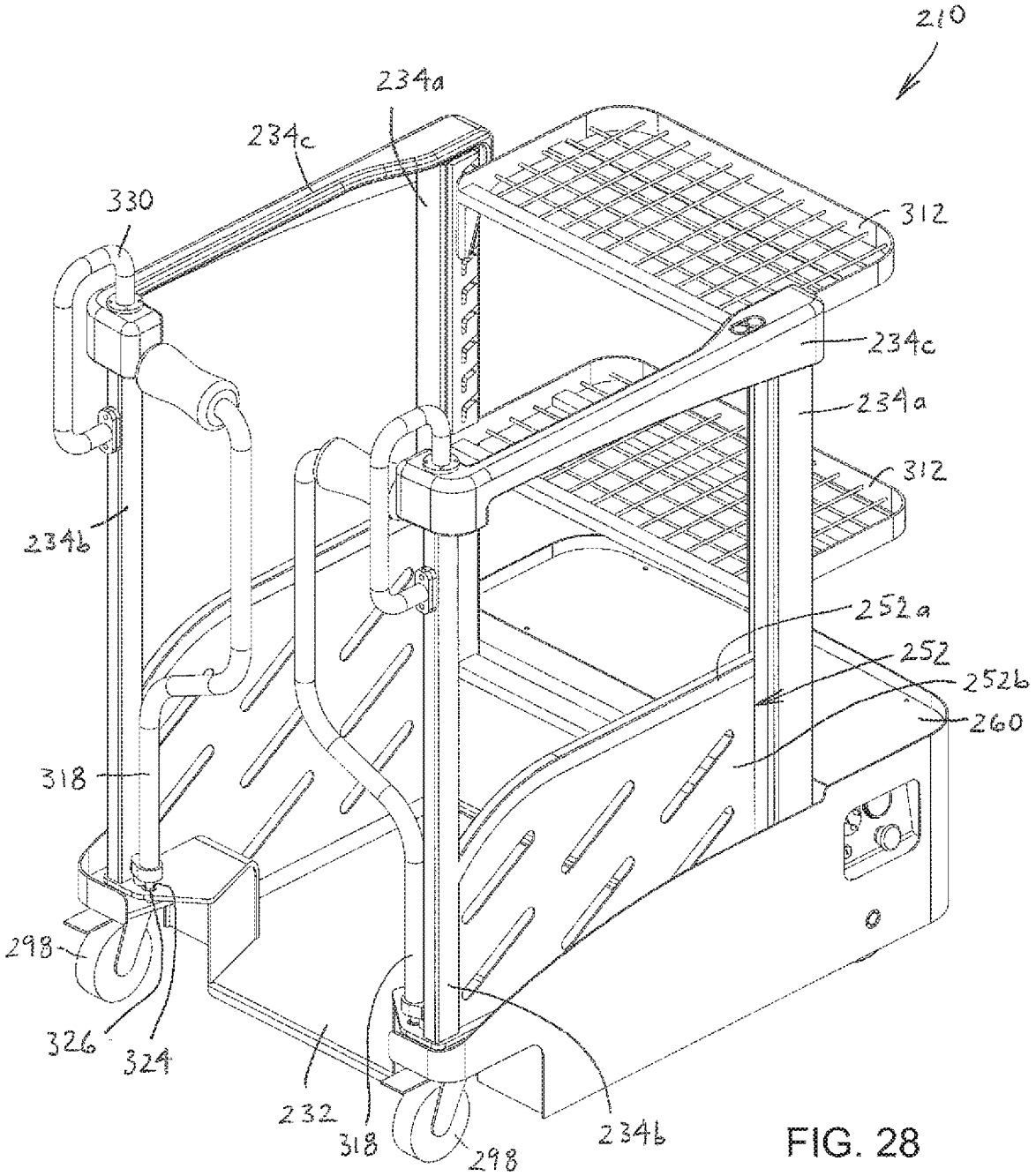
FIG. 28 is a right rear perspective view of the device of FIG. 13.
Figure 29:
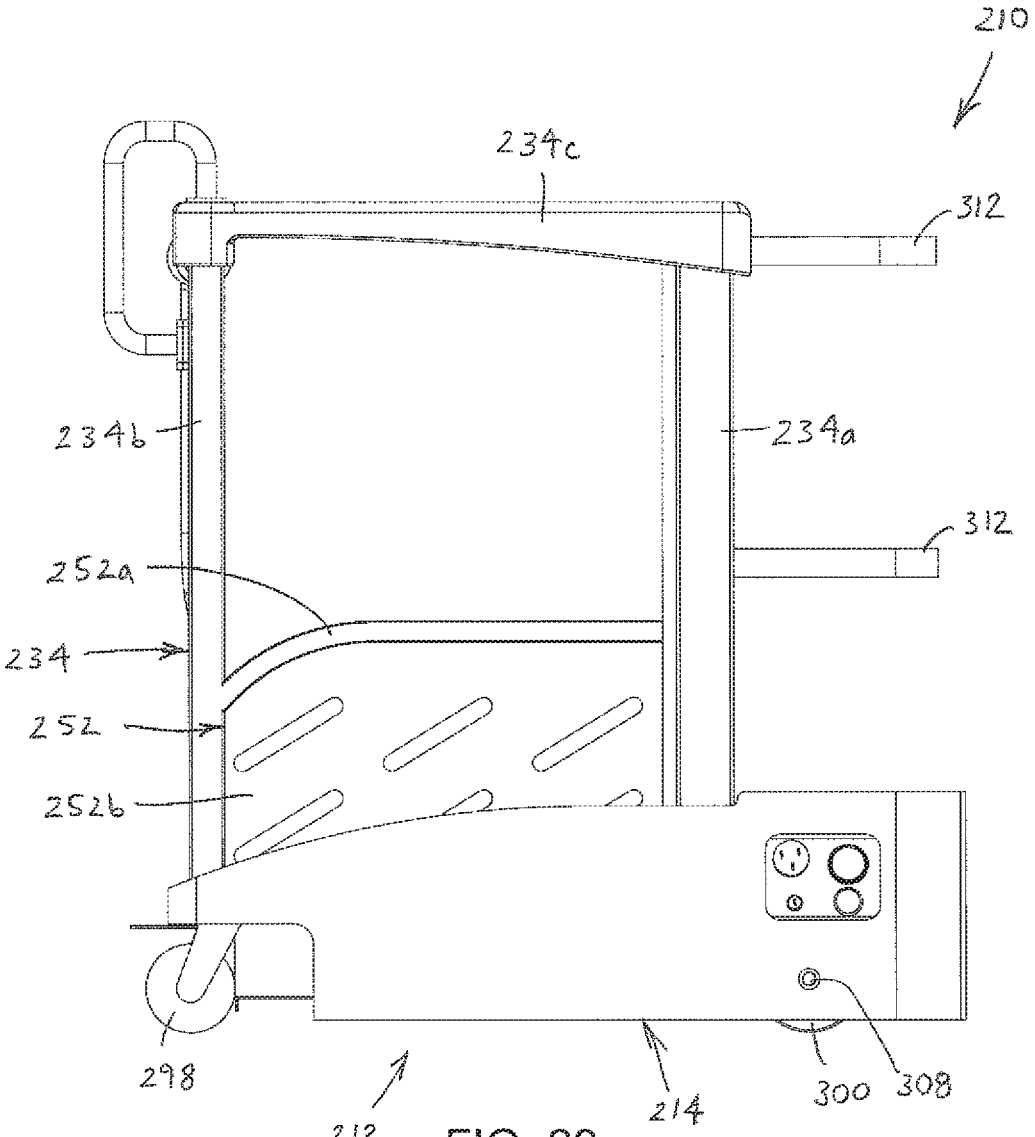
FIG. 29 is a right side plan view of the device of FIG. 13.
Figure 30:
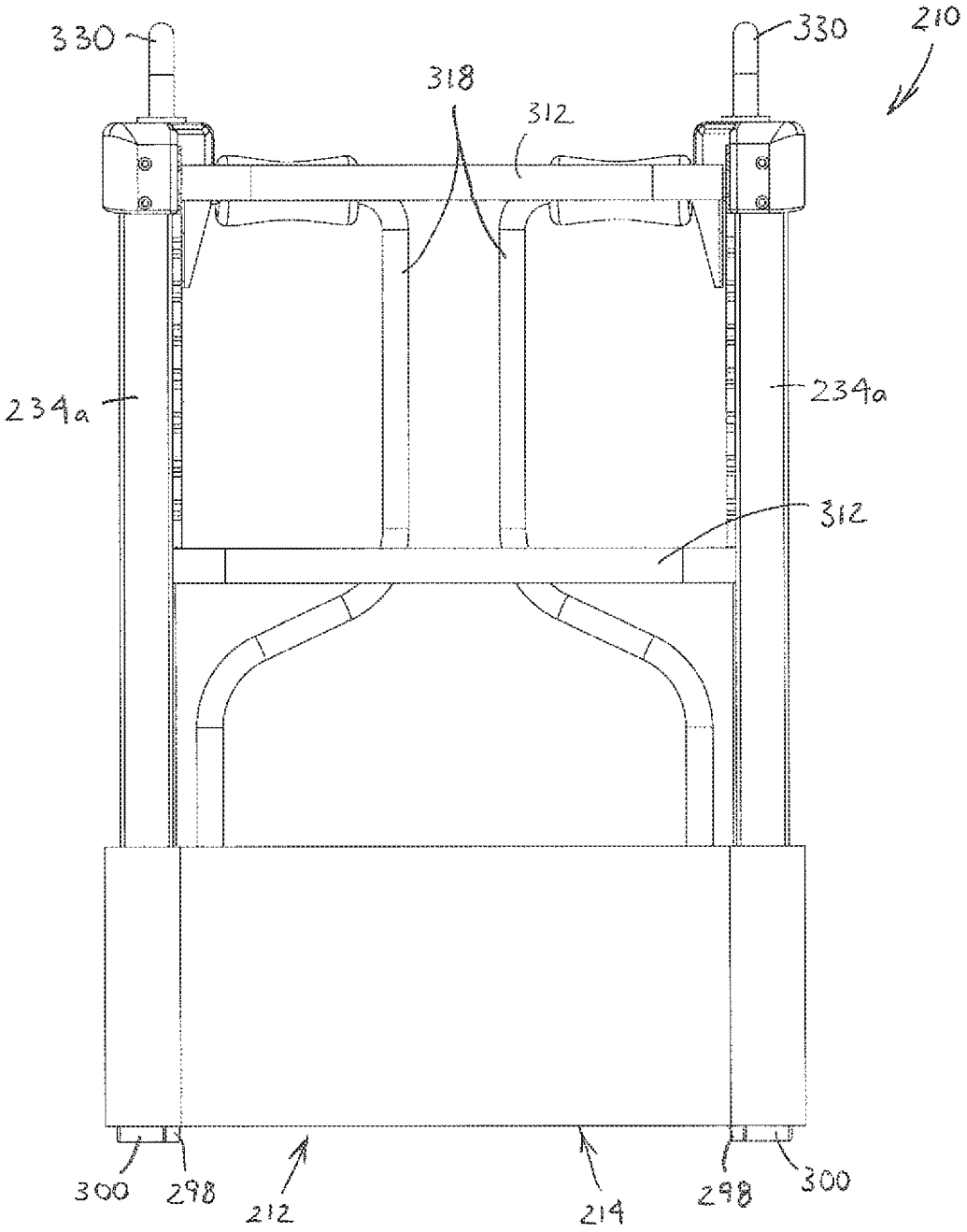
FIG. 30 is a front plan view of the device of FIG. 13.
Figure 31:
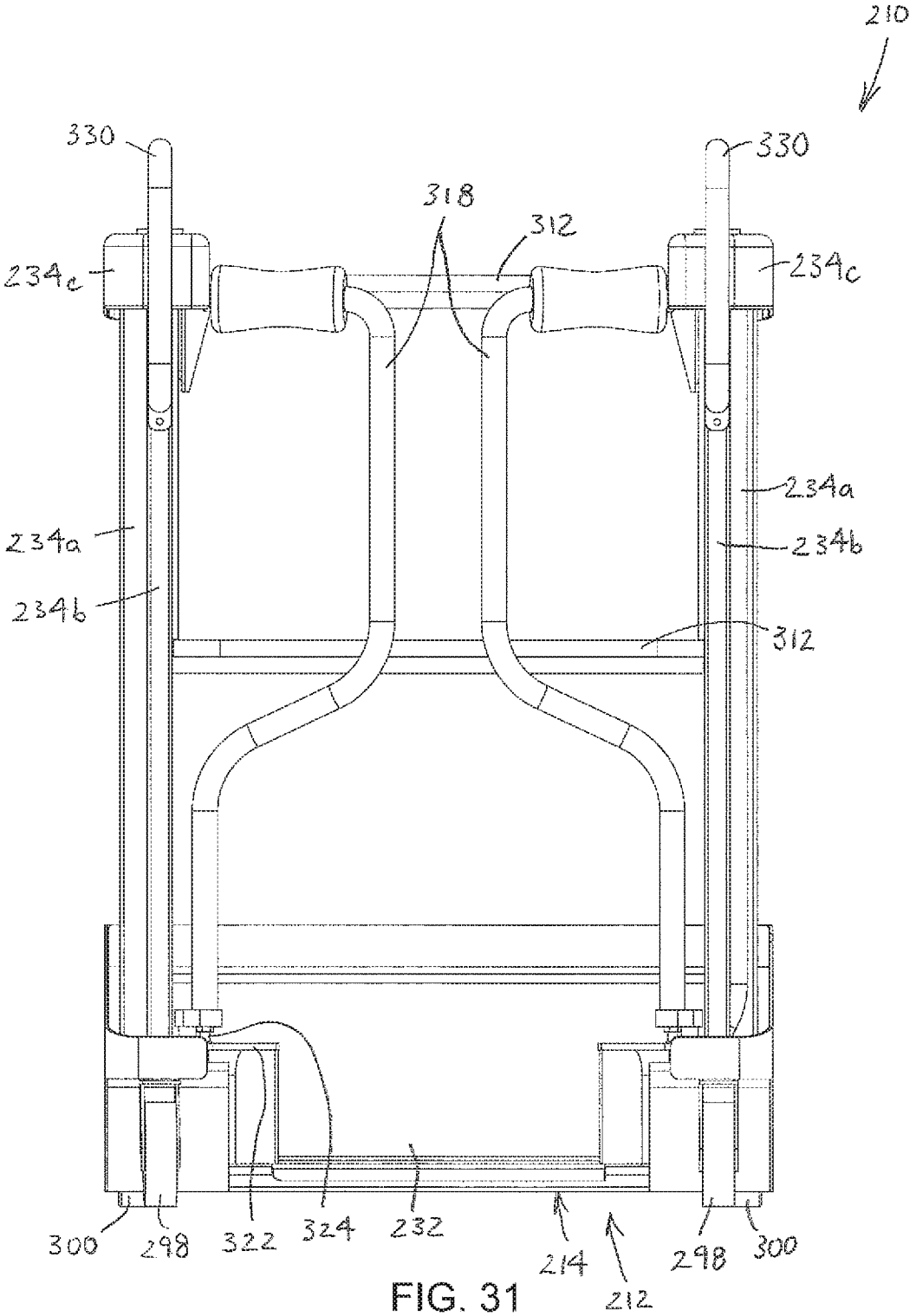
FIG. 31 is a rear plan view of the device of FIG. 13.
Figure 32:
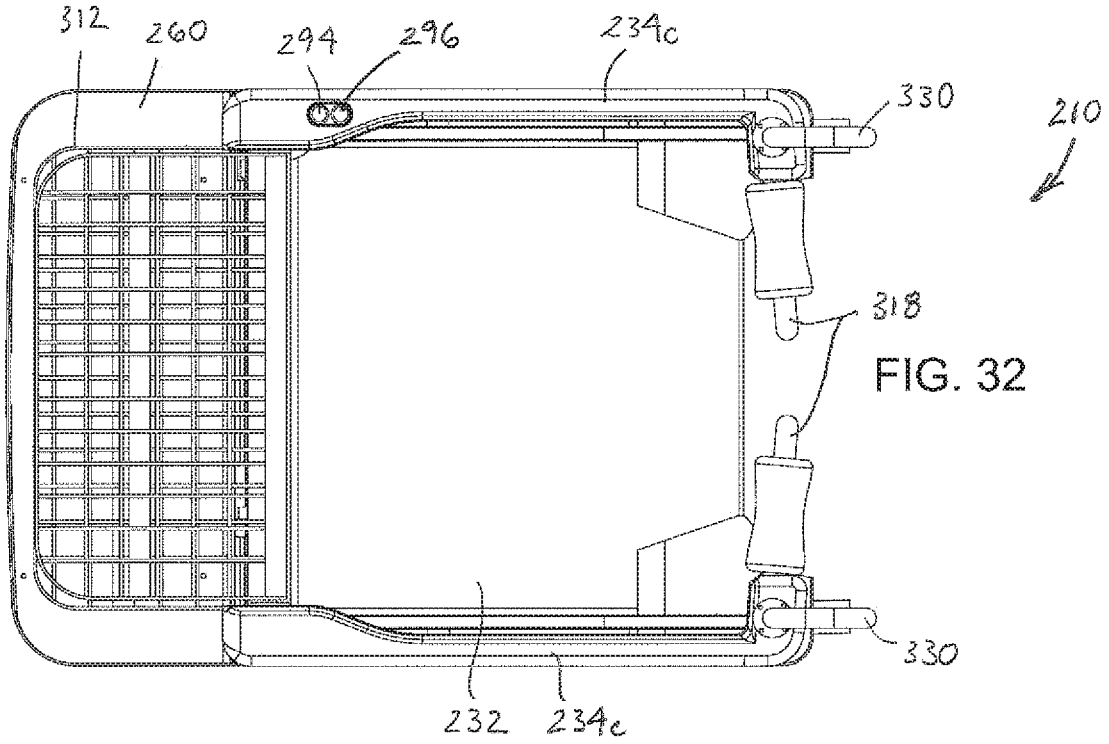
FIG. 32 is a top plan view of the device of FIG. 13.
Figure 33:
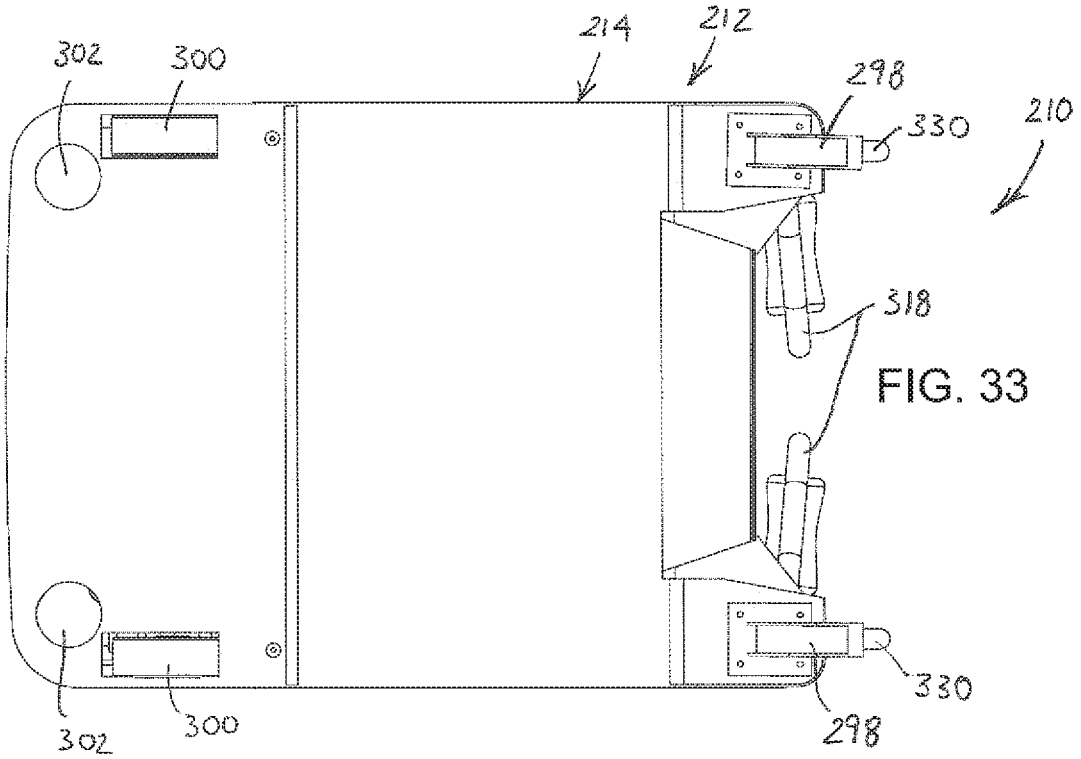
FIG. 33 is a bottom plan view of the device of FIG. 13.

Additional safety is provided by having gates 318 pivotally connected to the handrail assemblies 234 at the rear of the height adjustable platform assembly 230. Each gate 318 is connected to a spring biased hinge 320 at its upper end at the rear of an upper handrail portion 234*c*, and pivotally connected at its lower end to an extension 322 from the rearward upward extending portions 234*b*. As best appreciated in FIGS. 19 and 19A, the connection of the gates 318 permit pivoting forward, but move back to the original position when released, and do not permit pivoting rearward. Thus, an operator may conveniently press the gates 318 forward while stepping onto the operator platform 232, and once released, the gates 318 will close, blocking exit from the height adjustable platform assembly 230. As best seen in FIGS. 24 and 26, when the operator platform 232 of the second example is in a raised position shown in FIGS. 16, 19, 19B, 20 and 24, the bottom of the gates 318 have extended pegs 324 that drop into apertures 326 in the extensions 322, effectively locking the gates 318 because the gates 318 would need to be lifted to be permitted to rotate. Indeed, when the height adjustable platform assembly 230 is lower to the base assembly 212, upward projections 328 on the base assembly 212 extend upward through the apertures 326 to lift the gates 318 and permit them to be pivoted forward to an open position. Thus, the safety gate structures provide convenient locking and unlocking, in an intuitive manner.

Also provided for ease of ingress and egress are grip handles 330. Each grip handle 330 is fixedly connected at an upper end to the rear of an upper handrail portion 234*c* and at a lower end to a rearward upward extending portion 234*b*. The grip handles 330 provide for convenient locations for a user to grab ahold of the height adjustable platform assembly 230, which can be very helpful when stepping up onto or down from the operator platform 232.

It will be appreciated that the disclosed examples present numerous potential combinations of elements for carts and pallets and methods of their use. Thus, while the present disclosure shows and demonstrates various example carts that may be adapted for use in transporting pallets, these examples are merely illustrative and are not to be considered limiting. It will be apparent to those of ordinary skill in the art that various carts and pallets may be constructed and configured for use in moving goods, without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. An electric personnel lift device, comprising:

a base assembly having two columns that are laterally spaced apart and a plurality of wheel assemblies extending downward;

each of the two columns having a removable lift cylinder device located in the respective column and extending upward;

a height adjustable platform assembly having an operator platform and two laterally spaced apart handrail assemblies connected to the operator platform;

the height adjustable platform assembly is directly connected to an upper end of a movable portion of each removable lift cylinder device and slidably engages bushings in first and second opposed directions and that are connected to and located near upper ends of an outer surface of the columns and further comprises thrust adjustment between the height adjustable platform assembly and the columns in a third direction that is perpendicular to the first and second opposed directions;

wherein the height adjustable platform assembly is movable between at least a lowered position and a raised position;

wherein the two laterally spaced apart handrail assemblies conceal the two respective laterally spaced apart columns when the height adjustable platform assembly is in the lowered position and conceal moving parts of the two removable lift cylinder devices;

wherein the operator platform is cantilevered from and extends rearward relative to the two laterally spaced columns;

a hydraulic system further comprising a fluid reservoir, a hydraulic pump, an electric motor that drives the hydraulic pump and a power source connected to the electric motor; and wherein the hydraulic system is in fluid communication with the respective removable lift cylinder devices and is located within the base assembly, forward of the two laterally spaced columns and the height adjustable platform assembly.

2. The electric personnel lift device of claim 1, wherein when the height adjustable platform assembly is in the lowered position, the operator platform is adjacent the base assembly.

3. The electric personnel lift device of claim 1, wherein the thrust adjustment further comprises adjustable bushings at the lower ends of forward upward extending portions of the two laterally spaced apart handrail assemblies of the height adjustable platform.

4. The electric personnel lift device of claim 3, wherein each adjustable bushing further comprises a threaded collar and a complementary threaded thrust plug.

5. The electric personnel lift device of claim 4, wherein each handrail assembly further comprises an upper handrail portion connected to a forward upward extending portion and a rearward upward extending portion.

6. The electric personnel lift device of claim 1, wherein the height adjustable platform assembly further comprises a front cross member that is fixedly connected to the two laterally spaced apart handrail assemblies.

7. The electric personnel lift device of claim 1, wherein each column is connected to a bracket that is connected to the base assembly, wherein the bracket rigidly fixes the respective column in a vertical orientation.

8. The electric personnel lift device of claim 7, wherein each removable lift cylinder device is removably connected to the bracket.

9. The electric personnel lift device of claim 1, further comprising a battery as the power source connected to the electric motor.

10. The electric personnel lift device of claim 9, further comprising a battery charger and wherein the battery is a rechargeable battery.

11. The electric personnel lift device of claim 1, wherein the plurality of wheel assemblies further comprise at least two wheel assemblies that rotate about a fixed horizontal axis of rotation and at least two wheel assemblies that swivel about two spaced apart vertical axes.

12. The electric personnel lift device of claim 11, wherein the at least two wheel assemblies that rotate about a fixed horizontal axis of rotation are located proximate a front portion of the base assembly.

13. The electric personnel lift device of claim 1, wherein the base assembly further comprises a movable brake assembly having at least one foot.

14. The electric personnel lift device of claim 13, wherein the at least one foot further comprises two feet connected to a crossbar that is driven by a solenoid.

15. The electric personnel lift device of claim 1, wherein the height adjustable platform assembly further comprises at least one shelf.

16. The electric personnel lift device of claim 1, wherein the base assembly further comprises at least one shelf.

17. An electric personnel lift device, comprising:

a base assembly having two columns that are laterally spaced apart and a plurality of wheel assemblies extending downward;

each of the two columns being connected to a bracket that is connected to a frame of the base assembly, with the respective bracket rigidly fixing the respective column in a vertical orientation, and a removable lift cylinder device located in the respective column and being removably connected to the bracket and extending upward;

a height adjustable platform assembly having an operator platform and two laterally spaced apart handrail assemblies connected to the operator platform;

the height adjustable platform assembly is directly connected to an upper end of a movable portion of each lift cylinder device and slidably engages bushings in first and second opposed directions and that are connected to and located near upper ends of an outer surface of the columns and further comprises thrust adjustment between the height adjustable platform assembly and the columns in a third direction that is perpendicular to the first and second opposed directions;

wherein the height adjustable platform assembly is movable between at least a lowered position and a raised position;

wherein the two laterally spaced apart handrail assemblies conceal the two respective laterally spaced apart columns when the height adjustable platform assembly is in the lowered position and conceal moving parts of the two lift cylinder devices;

wherein the operator platform is cantilevered from and extends rearward relative to the two laterally spaced columns;

a hydraulic system further comprising a fluid reservoir, a hydraulic pump, an electric motor that drives the hydraulic pump and a power source connected to the electric motor; and wherein the hydraulic system is in fluid communication with the respective lift cylinder devices and is located within the base assembly, forward of the two laterally spaced columns and the height adjustable platform assembly.

* * * * *